US010540838B2

(12) United States Patent
Tachi et al.

(10) Patent No.: US 10,540,838 B2
(45) Date of Patent: Jan. 21, 2020

(54) ARTICLE DISPENSING APPARATUS

(71) Applicant: FUJI ELECTRIC CO., LTD., Kawasaki-shi, Kanagawa (JP)

(72) Inventors: Yuji Tachi, Yokkaichi (JP); Kenji Muto, Yokkaichi (JP); Shirou Takeuchi, Yokkaichi (JP); Tatsurou Sugaya, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/602,788

(22) Filed: May 23, 2017

(65) Prior Publication Data

US 2017/0256118 A1 Sep. 7, 2017

Related U.S. Application Data

(63) Continuation of application No. PCT/JP2015/081537, filed on Nov. 10, 2015.

(30) Foreign Application Priority Data

Dec. 18, 2014 (JP) ..... 2014-256560

(51) Int. Cl.
*G07F 11/24* (2006.01)
*G07F 9/02* (2006.01)

(52) U.S. Cl.
CPC ..... *G07F 11/24* (2013.01); *G07F 9/02* (2013.01)

(58) Field of Classification Search
USPC ..... 221/251
See application file for complete search history.

(56) References Cited

U.S. PATENT DOCUMENTS 2,369,882 A * 2/1945 Brock ..... G07F 11/08 16/96 R
4,423,828 A * 1/1984 Tanaka ..... G07F 11/10 221/129

(Continued)

FOREIGN PATENT DOCUMENTS

JP H07-093654 A 4/1995
JP 11283096 A * 10/1999

(Continued)

OTHER PUBLICATIONS

PCT/JP2015/081537 "International Search Report" dated Dec. 8, 2015.

(Continued)

*Primary Examiner* — Gene O Crawford
*Assistant Examiner* — Kelvin L Randall, Jr.
(74) *Attorney, Agent, or Firm* — Manabu Kanesaka

(57) ABSTRACT

An article dispensing apparatus includes: an article discharging apparatus including a lower pedal and an upper pedal; an out-of-stock detection switch configured to: be turned to a first state when the lower pedal is turned to a second standby attitude; and be turned to a second state when the lower pedal is turned to any attitude other than the second standby attitude; and a controller configured to determine that an article has been dispensed from an article storage passage by the fact that the out-of-stock detection switch is turned to the first state when the article discharging apparatus is driven.

5 Claims, 30 Drawing Sheets

(56) References Cited

U.S. PATENT DOCUMENTS

| | | | | | |
|---|---|---|---|---|---|
| 4,574,980 | A * | 3/1986 | Kurosawa | G07F 11/24 | 221/116 |
| 4,676,398 | A * | 6/1987 | Kokubun | G07F 11/24 | 221/129 |
| 5,445,296 | A * | 8/1995 | Insausti | B65G 59/062 | 221/298 |
| 5,511,690 | A * | 4/1996 | Calhoun | B65G 59/062 | 221/197 |
| 6,467,648 | B1 * | 10/2002 | Nishiyama | G07F 11/06 | 221/289 |

FOREIGN PATENT DOCUMENTS

| | | | |
|---|---|---|---|
| JP | 2001-188953 | A | 7/2001 |
| JP | 2001-188953 | A | 10/2001 |
| JP | 2002-358565 | A | 12/2002 |
| JP | 2007-148552 | A | 6/2007 |

OTHER PUBLICATIONS

Japan Patent Office, "Office Action for Japanese Patent Application No. 2016-564733," dated Jan. 30, 2018.

* cited by examiner

ARTICLE DISPENSING APPARATUS

CROSS REFERENCES TO RELATED APPLICATIONS

This application is a continuation of PCT international application Ser. No. PCT/JP2015/081537 filed on Nov. 10, 2015 which designates the United States, incorporated herein by reference, and which claims the benefit of priority from Japanese Patent Applications No. 2014-256560, filed on Dec. 18, 2014, incorporated herein by reference.

BACKGROUND

1. Technical Field

The disclosure relates to an article dispensing apparatus, and more specifically, to an article dispensing apparatus that is used for vending machines that sell articles such as canned beverages and PET-bottled beverages and discharges articles stored in article storage passages as appropriate.

2. Related Art

In vending machines that sell articles such as canned beverages and PET-bottled beverages, an article storage rack has been conventionally provided in an article storage inside a main body cabinet as a vending machine main body. The article storage rack has article storage passages extending in an up-and-down direction and article discharging apparatuses arranged at the lower part of the article storage passages.

The article discharging apparatus includes a lower pedal and an upper pedal. The lower pedal and the upper pedal are linked with an AC solenoid as an actuator via links and advance and retract to and from the article storage passage as appropriate through the energization of the AC solenoid.

In such an article discharging apparatus, in a standby state, the upper pedal is retracted from the article storage passage, whereas the lower pedal is advanced to the article storage passage. With this configuration, the lower pedal comes into contact with the lowermost article stored in the article storage passage, thereby preventing articles stored in the article storage passage from moving downward.

When a discharging instruction for an article is given, in the article discharging apparatus at the lower part of the article storage passage that stores therein a corresponding article, the AC solenoid is energized, whereby the upper pedal advances to the article storage passage via the link to come into contact with the second lowermost article, thereby preventing the article and articles stored above the article from moving downward. In addition, the AC solenoid is energized, whereby the lower pedal retracts from the article storage passage, only the lowermost article is discharged downward, and when the article slips through the lower pedal, the lower pedal advances to the article storage passage by the biasing force of a spring. After that, when the energized state of the AC solenoid is released to be a non-energized state, the lower pedal that has advanced to the article storage passage is prevented from retracting, and the upper pedal has retracted from the article storage passage, thereby returning to the standby state.

The article discharging apparatus includes an out-of-stock detection lever and an out-of-stock detection switch in addition to the pedals. The out-of-stock detection lever is swingably arranged in such a manner as to advance and retract to and from the article storage passage in an area above the upper pedal and is biased to advance to the article storage passage by a biasing unit. When an article is present in the article storage passage, the out-of-stock detection lever retracts from the article storage passage against the biasing force of the biasing unit by the article.

The out-of-stock detection switch is linked with the out-of-stock detection lever, turned to an off state when the out-of-stock detection lever has retracted from the article storage passage, and turned to an on state when the out-of-stock detection lever has advanced to the article storage passage. This out-of-stock detection switch is turned to the on state to determine that the article in the article storage passage has been out of stock and outputs an out-of-stock signal (refer to Japanese Patent application Laid-open No. 2001-188953, for example).

SUMMARY

Although the article discharging apparatus described in Japanese Patent application Laid-open No. 2001-188953 described above can detect the article being out of stock in the article storage passage by the out-of-stock detection lever and the out-of-stock detection switch, the downward discharging of the lowermost article in the article storage passage is left to take its own course, and it is difficult to detect that the article has been surely dispensed.

Given these circumstances, to detect that the article has been surely dispensed from the article discharging apparatus, a sensor or the like is required to be provided at another place to detect the passage of the article, resulting in an increase in manufacturing costs caused by an increase in parts count, which is not favorable.

It is an object of the disclosure to at least partially solve the problems in the conventional technology.

In some embodiments, an article dispensing apparatus includes: an article discharging apparatus including: a lower pedal swingably arranged on a base in such a manner as to cause a tip of the lower pedal to advance and retract to and from an article storage passage configured to store therein charged articles in an up-and-down direction; and an upper pedal swingably arranged on the base in such a manner as to cause a tip of the upper pedal to advance and retract to and from the article storage passage in an area above the lower pedal, the article dispensing apparatus being configured to: advance the lower pedal to the article storage passage while retracting the upper pedal from the article storage passage to cause the lower pedal to place the lowermost article on an upper face of the lower pedal to be turned to a first standby attitude to prevent the article from moving downward in a standby state; and retract the lower pedal from the article storage passage to discharge the lowermost article downward while advancing the upper pedal to the article storage passage to come into contact with the second lowermost article when being driven, the lower pedal being configured to be turned to a second standby attitude in which the tip of the lower pedal is positioned at an upper position than the first standby attitude when no article is placed on the upper face when advanced to the article storage passage; an out-of-stock detection switch configured to: be turned to a first state when the lower pedal is turned to the second standby attitude; and be turned to a second state when the lower pedal is turned to any attitude other than the second standby attitude; and a controller configured to determine that an article has been dispensed from the article storage passage by the fact that the out-of-stock detection switch is turned to the first state when the article discharging apparatus is driven.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

The following describes a preferred embodiment of an article dispensing apparatus according to the disclosure in detail with reference to the accompanying drawings.

Figure 1:
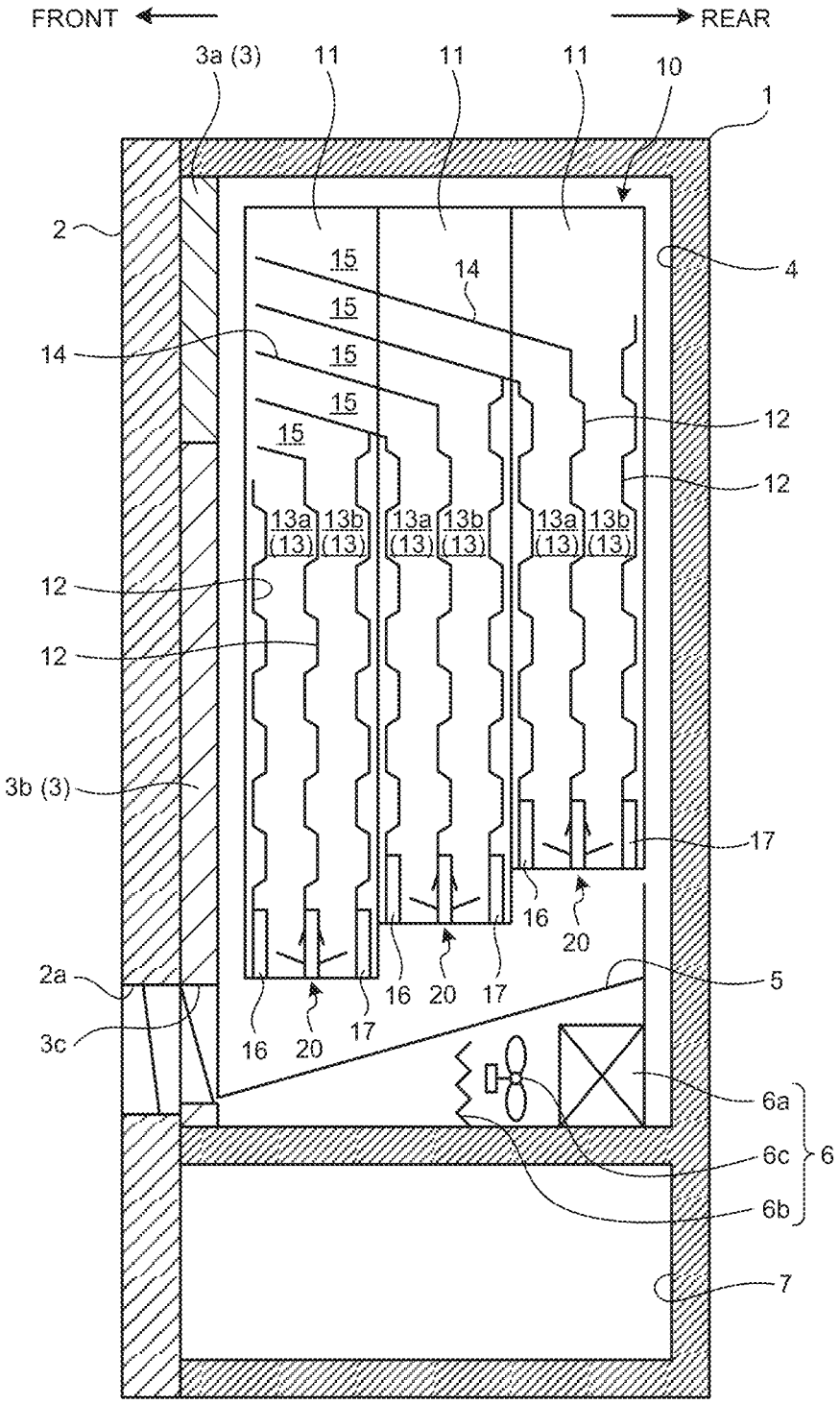
FIG. 1 is a sectional side view when viewing an internal structure of a vending machine in which an article dispensing apparatus as an embodiment of the disclosure is used from the right.

FIG. 1 is a sectional side view when viewing an internal structure of a vending machine in which the article dispensing apparatus as the embodiment of the disclosure is used from the right. The vending machine illustrated in this example sells articles cooled or heated and includes a main body cabinet 1, an outer door 2, and an inner door 3.

The main body cabinet 1 is formed in a rectangular parallelepipedal shape with its front open by combining a plurality of steel sheets as appropriate and includes an article storage 4 with a heat insulating structure thereinside. The outer door 2 is for covering the front opening of the main body cabinet 1 and is arranged on one side edge of the main body cabinet 1 in an openable and closable manner. Provided on the front face of this outer door 2 are requirements for selling articles such as a display window, article selection buttons, a bill insertion port, a coin slot, a return lever, an integral display, a coin drop, and an article outlet port 2*a*. The inner door 3 is a heat insulting door divided into up-and-down two parts for covering the front opening of the article storage 4, in which inside the outer door 2 an upper heat insulating door 3*a* is arranged on one side edge of the outer door 2 in an openable and closable manner, whereas a lower heat insulating door 3*b* is arranged on one side edge of the main body cabinet 1 in an openable and closable manner. An article discharging port 3*c* for discharging articles outside the article storage 4 is provided below the lower heat insulating door 3*b* of the inner door 3.

In the vending machine, an article chute 5 is provided inside the article storage 4; a temperature adjusting unit 6 is arranged in an area (hereinafter, also referred to as a "heat exchange area") below this article chute 5, whereas article storage racks 10 are arranged in an area (hereinafter, also referred to as an "article storage area") above this article chute 5.

The article chute 5 is a plate-shaped member for guiding articles discharged from the article storage racks 10 to the article discharging port 3*c* of the inner door 3 and is arranged in such a manner as to gradually incline downward toward the front. Although not being explicitly illustrated in the drawing, this article chute 5 is formed with many vent holes causing the heat exchange area and the article storage area to communicate with each other.

The temperature adjusting unit 6 is for maintaining the internal atmosphere of the article storage 4 at a desired temperature condition and includes an evaporator 6*a* for the refrigerating cycle, an electric heater 6*b*, and an air-blowing fan 6*c*. In this temperature adjusting unit 6, when the air-blowing fan 6*c* is driven with the refrigerating cycle operated, for example, air cooled by the evaporator 6*a* is supplied upward through the vent holes of the article chute 5, whereby the article storage area can be maintained at a low temperature state. In contrast, when the air-blowing fan 6*c* is driven with the electric heater 6*b* energized, air heated by the electric heater 6*b* is supplied upward through the vent holes of the article chute 5, whereby the article storage area can be maintained at a high temperature state. A compressor and a condenser for the refrigerating cycle and an expansion valve are arranged in a machinery room 7 outside the article storage 4, although they are not explicitly illustrated in the drawing.

The article storage racks 10 are arranged in three rows fore and aft, include a plurality of (two in the illustrated example) article storage passages 13 formed zigzag in an up-and-down direction by arranging passage forming elements 12 between a pair of base side plates 11, and store a plurality of articles with an attitude turned on their sides in the up-and-down direction inside these article storage passages 13. More specifically, the passage forming elements 12 are arranged as appropriate so as to face each other on the front side and the rear side of the article storage passage 13 and are fixed to the base side plates 11. With this configuration, in each of the article storage racks 10, the two article storage passages 13 are provided in such a manner as to be adjacent to each other fore and aft. In the following description, in one article storage rack 10, the front article storage passage 13 will be referred to also as a first article storage passage 13*a*, whereas the rear article storage passage 13 will be referred to also as a second article storage passage 13*b*.

The passage forming element 12 is provided with a flapper, which is not explicitly illustrated in the drawing. The flapper is swingably arranged on the passage forming element 12 in such a manner as to advance and retract to and from the article storage passage 13. This flapper is in an attitude advanced to the article storage passage 13 in a normal state by being biased by a coil spring (not illustrated). Coming into contact with an article passing through the article storage passage 13, the flapper itself retracts so as to be along the zigzag article storage passage 13 against the biasing force of the coil spring to correct the attitude of the article.

In each of the article storage racks 10, a top tray 14 is provided at the upper part of the article storage passage 13, whereas an article dispensing apparatus 20 is provided at the lower part of the article storage passage 13.

The top tray 14 is formed by bending plate-shaped sheet metal and is arranged between the base side plates 11 in such a manner as to gradually incline downward from the front toward the rear. The upper face of this top tray 14 forms an article guiding passage 15 that guides articles charged through a charging port to the article storage passage 13.

Figure 2:
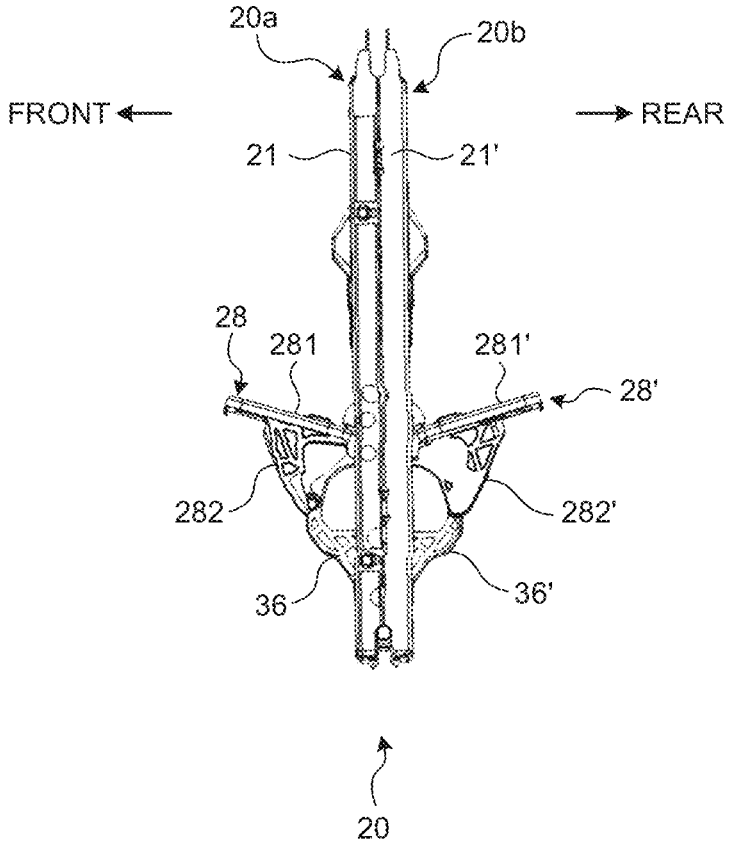
FIG. 2 is a side view when viewing the article dispensing apparatus illustrated in FIG. 1 from the right.
Figure 3:
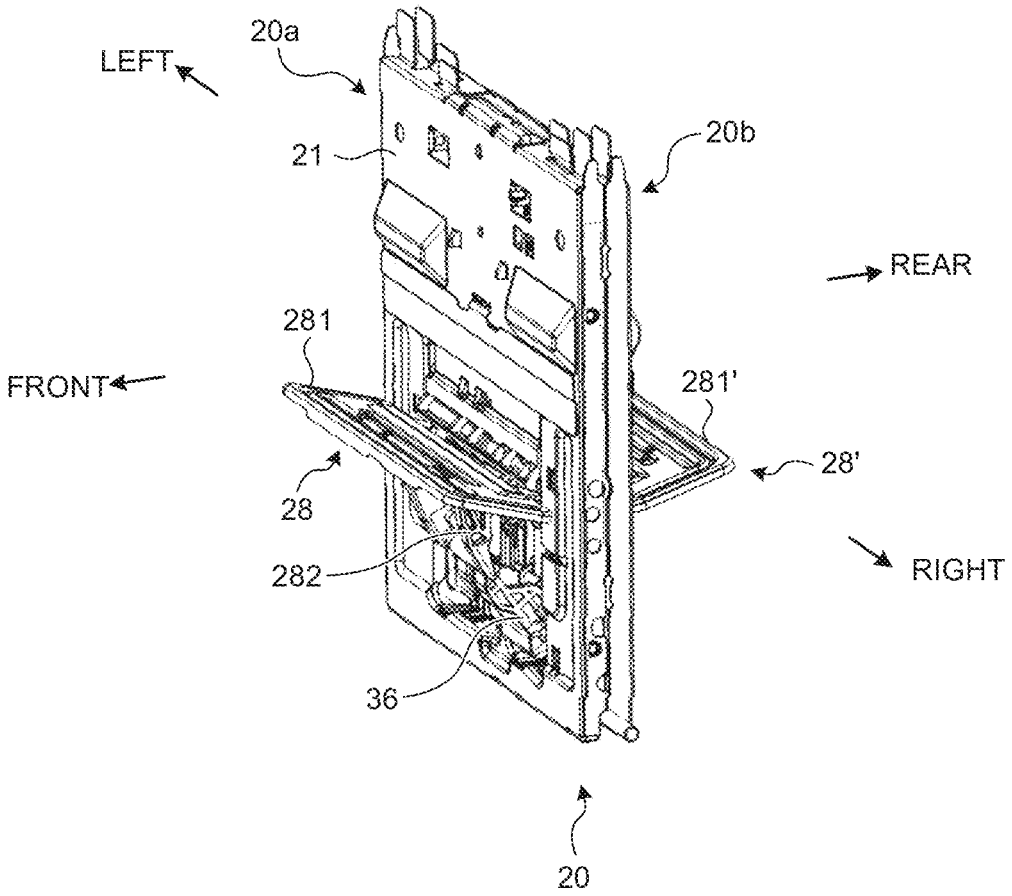
FIG. 3 is a perspective view when viewing the article dispensing apparatus illustrated in FIG. 1 from the right front.
Figure 4:
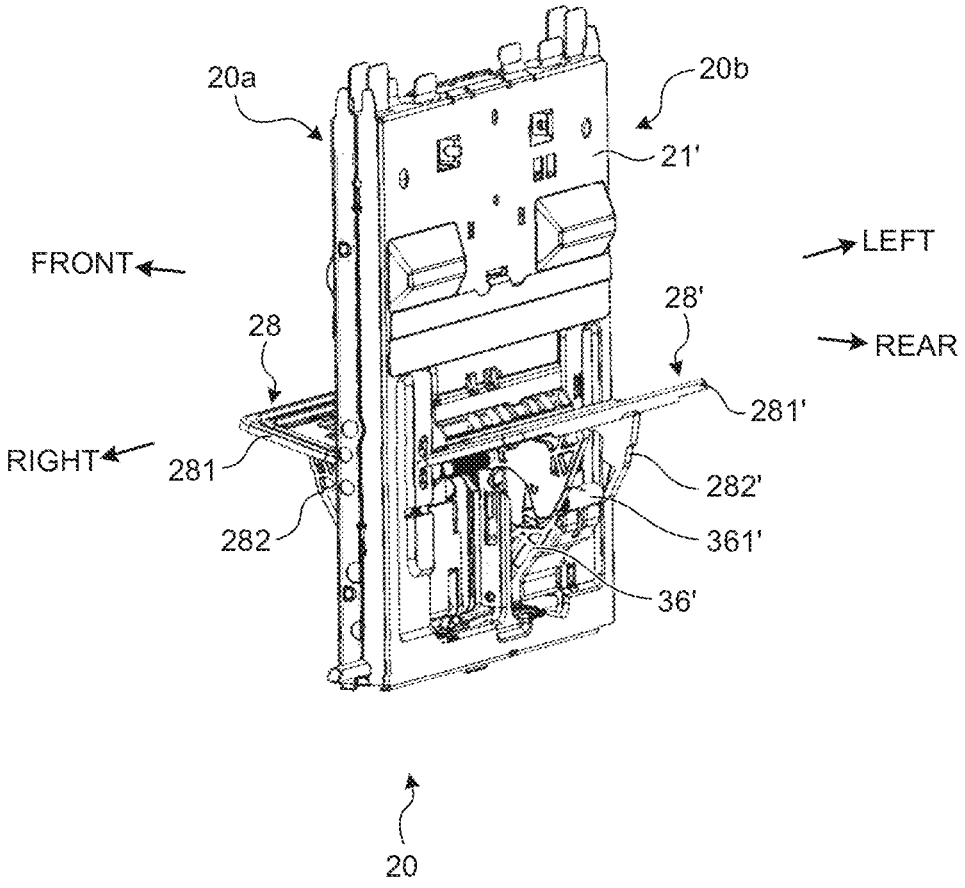
FIG. 4 is a perspective view when viewing the article dispensing apparatus illustrated in FIG. 1 from the right rear.

FIG. 2 to FIG. 4 illustrate the article dispensing apparatus 20 illustrated in FIG. 1: FIG. 2 is a side view when viewed from the right; FIG. 3 is a perspective view when viewed from the right front; and FIG. 4 is a perspective view when viewed from the right rear.

As illustrated in FIG. 2 to FIG. 4, the article dispensing apparatus 20 includes one article discharging apparatus (hereinafter, referred to also as a first article discharging apparatus) 20*a* and another article discharging apparatus (hereinafter, referred to also as a second article discharging apparatus) 20*b*, in which the first article discharging apparatus 20*a* and the second article discharging apparatus 20*b* are combined in a back-to-back manner. FIG. 2 to FIG. 4 illustrate a state in which no article is stored in both the first article discharging apparatus 20*a* and the second article discharging apparatus 20*b* included in the article dispensing apparatus 20.

Figure 5:
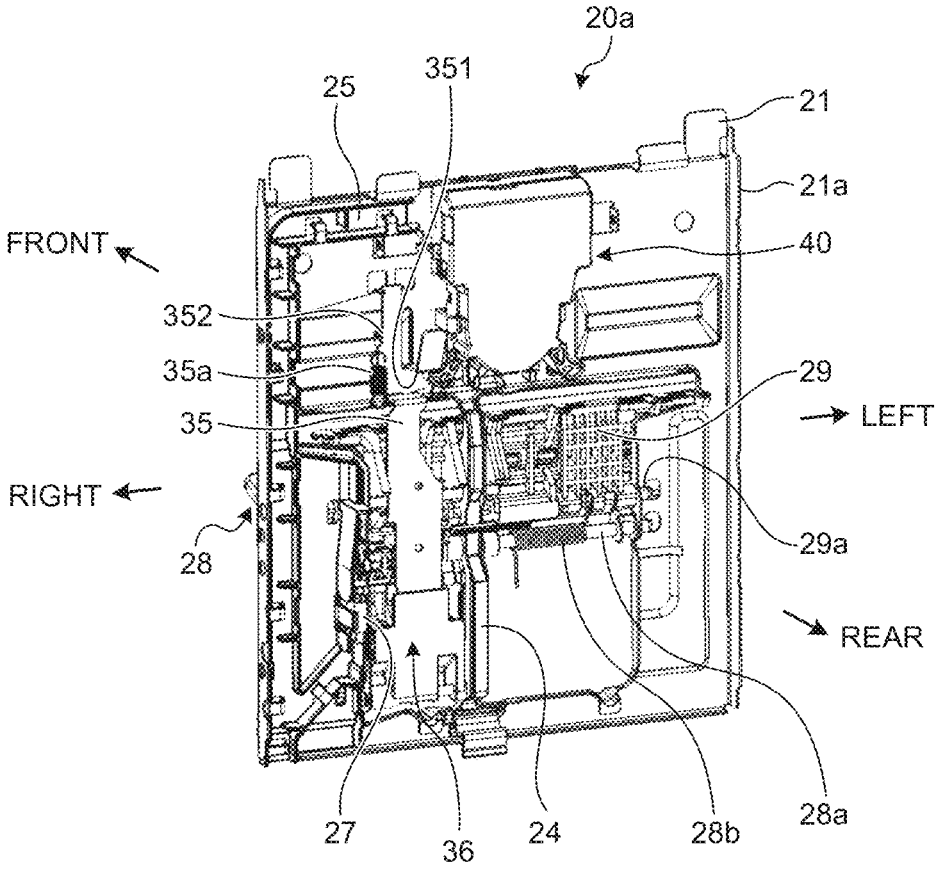
FIG. 5 is a perspective view when viewing a first article discharging apparatus illustrated in FIG. 2 to FIG. 4 from the right rear.

FIG. 5 is a perspective view when viewing the first article discharging apparatus 20*a* illustrated in FIG. 2 to FIG. 4 from the right rear. The following describes a configuration of the first article discharging apparatus 20*a* and then describes the second article discharging apparatus 20*b*.

Figure 6:
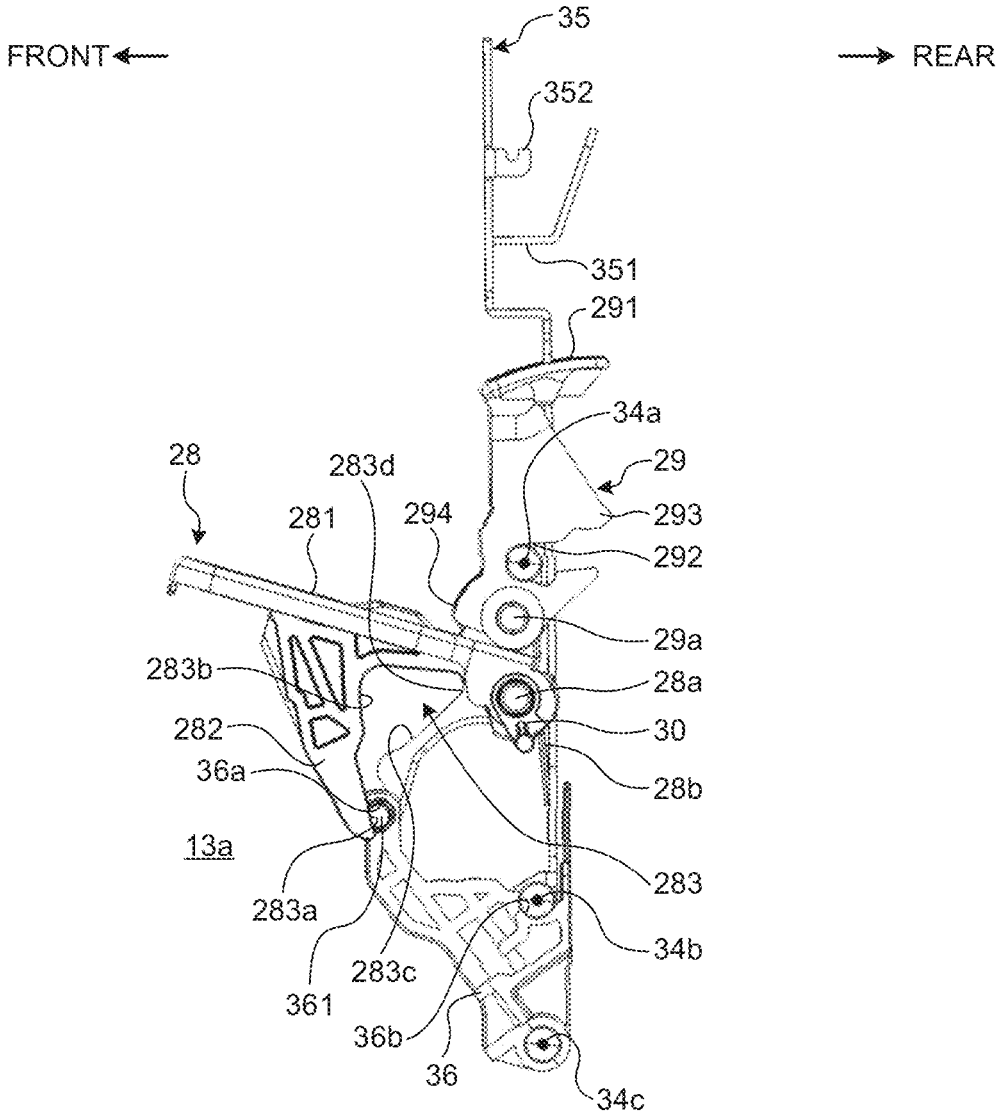
FIG. 6 is a schematic illustrative diagram when viewing a principal part of the first article discharging apparatus illustrated in FIG. 2 to FIG. 5 from the right.
Figure 7:
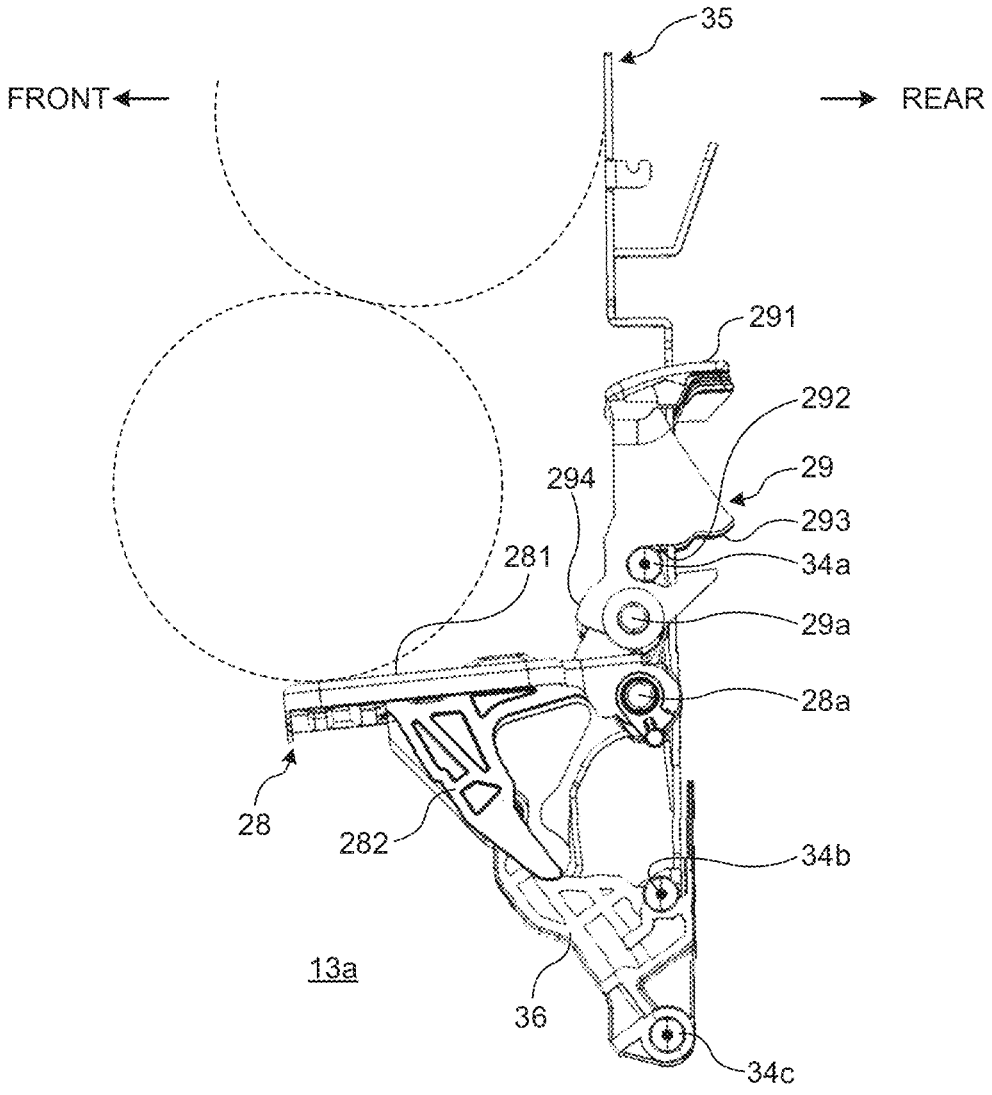
FIG. 7 is a schematic illustrative diagram when viewing the principal part of the first article discharging apparatus illustrated in FIG. 2 to FIG. 5 from the right.
Figure 8:
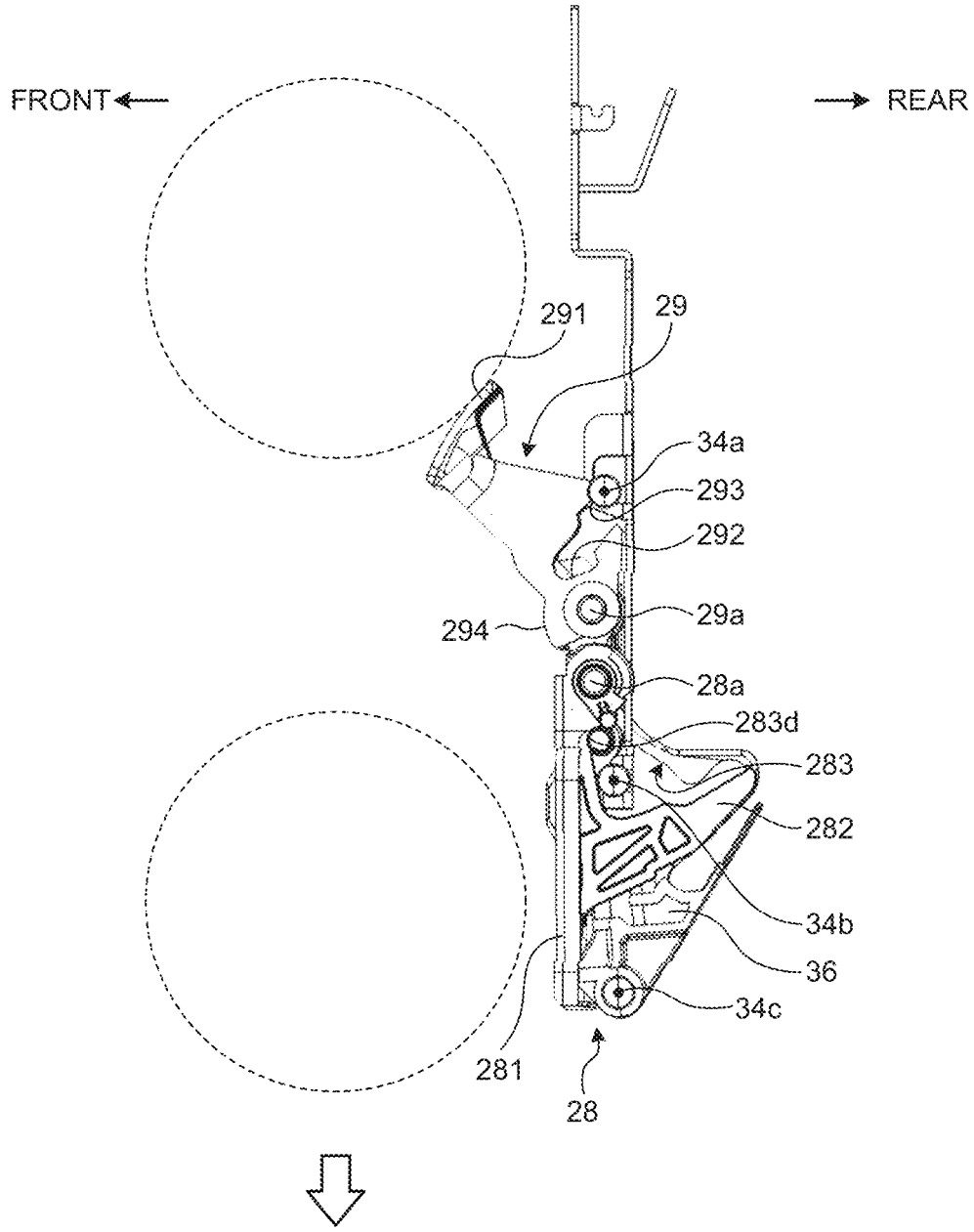
FIG. 8 is a schematic illustrative diagram when viewing the principal part of the first article discharging apparatus illustrated in FIG. 2 to FIG. 5 from the right.

FIG. 6 to FIG. 8 are schematic illustrative diagrams when viewing a principal part of the first article discharging apparatus 20*a* illustrated in FIG. 2 to FIG. 5 from the right. The following describes the configuration of the first article discharging apparatus 20*a* with reference also to FIG. 6 to FIG. 8 as appropriate.

The first article discharging apparatus 20*a* is used for the first article storage passage 13*a* and arranged at the lower part of this first article storage passage 13*a*. This first article discharging apparatus 20*a* controls the behavior of articles between the first article discharging apparatus 20*a* and a passage width defining plate 16 facing it, thereby functioning to store the articles in the first article storage passage 13*a* in a discharge standby state and to discharge a corresponding article one by one to the article chute 5 when being driven and includes a base 21.

Figure 9:
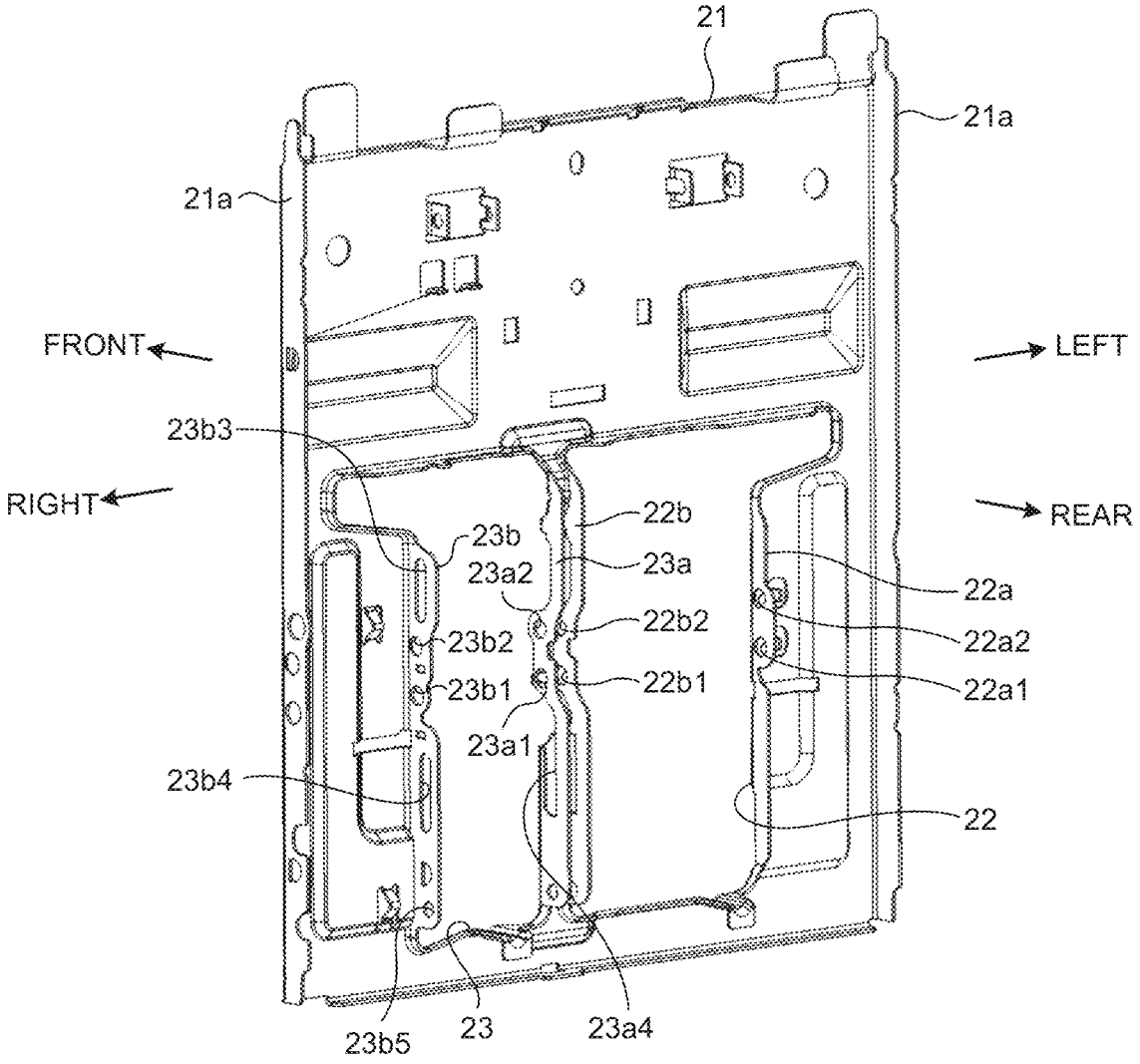
FIG. 9 is a perspective view of a base of the first article discharging apparatus illustrated in FIG. 2 to FIG. 5.

As illustrated in FIG. 9, the base 21 is formed by performing cutting and bending on a steel sheet and is arranged in such a manner as to cause its surface to face the passage width defining plate 16. This base 21 is formed with side walls 21*a* by causing its both ends to be bent and is formed with a first insertion hole 22 and a second insertion hole 23 in its intermediate part. The peripheries of the first insertion hole 22 and the second insertion hole 23 are bent similarly to the side walls 21*a* to form flanges.

The first insertion hole 22 and the second insertion hole 23 are formed so as to be next to each other right and left and have the same up-and-down dimension. As to the first insertion hole 22 and the second insertion hole 23, the first insertion hole 22 is positioned on the left side of the second insertion hole 23, and the right-and-left width of the first insertion hole 22 is larger than the right-and-left width of the second insertion hole 23. The first insertion hole 22 and the second insertion hole 23 are both through openings (recesses causing a lower pedal 28 and an upper pedal 29 described below to retract to within the base 21) formed in a substantially rectangular shape as a whole; the upper end of the first insertion hole 22 protrudes leftward, whereas the upper end of the second insertion hole 23 protrudes rightward. A first left shaft support piece 22*a* is provided on the left side edge of the first insertion hole 22, whereas a first right shaft support piece 22*b* is provide on the right side edge of the first insertion hole 22; a second left shaft support piece 23*a* is provided on the left side edge of the second insertion hole 23, whereas a second right shaft support piece 23*b* is provided on the right side edge of the second insertion hole 23. The first left shaft support piece 22*a* and the second right shaft support piece 23*b* correspond to the flanges formed on the peripheries of the first insertion hole 22 and the second insertion hole 23. The first right shaft support piece 22*b* and the second left shaft support piece 23*a* are formed in shaft inserting flanges forming U-shaped both leg pieces in a shaft support holding part that is formed integrally with the base 21 and is formed to have a U-shaped transverse cross section (discontinuous) that holds a shaft support part 24 described below in a fitted manner. This shaft support holding part has a function of maintaining the strength of the base 21 also when a large through opening including the first insertion hole 22 and the second insertion hole 23 formed in a substantially rectangular shape as a whole is formed in the base 21.

Figure 10:
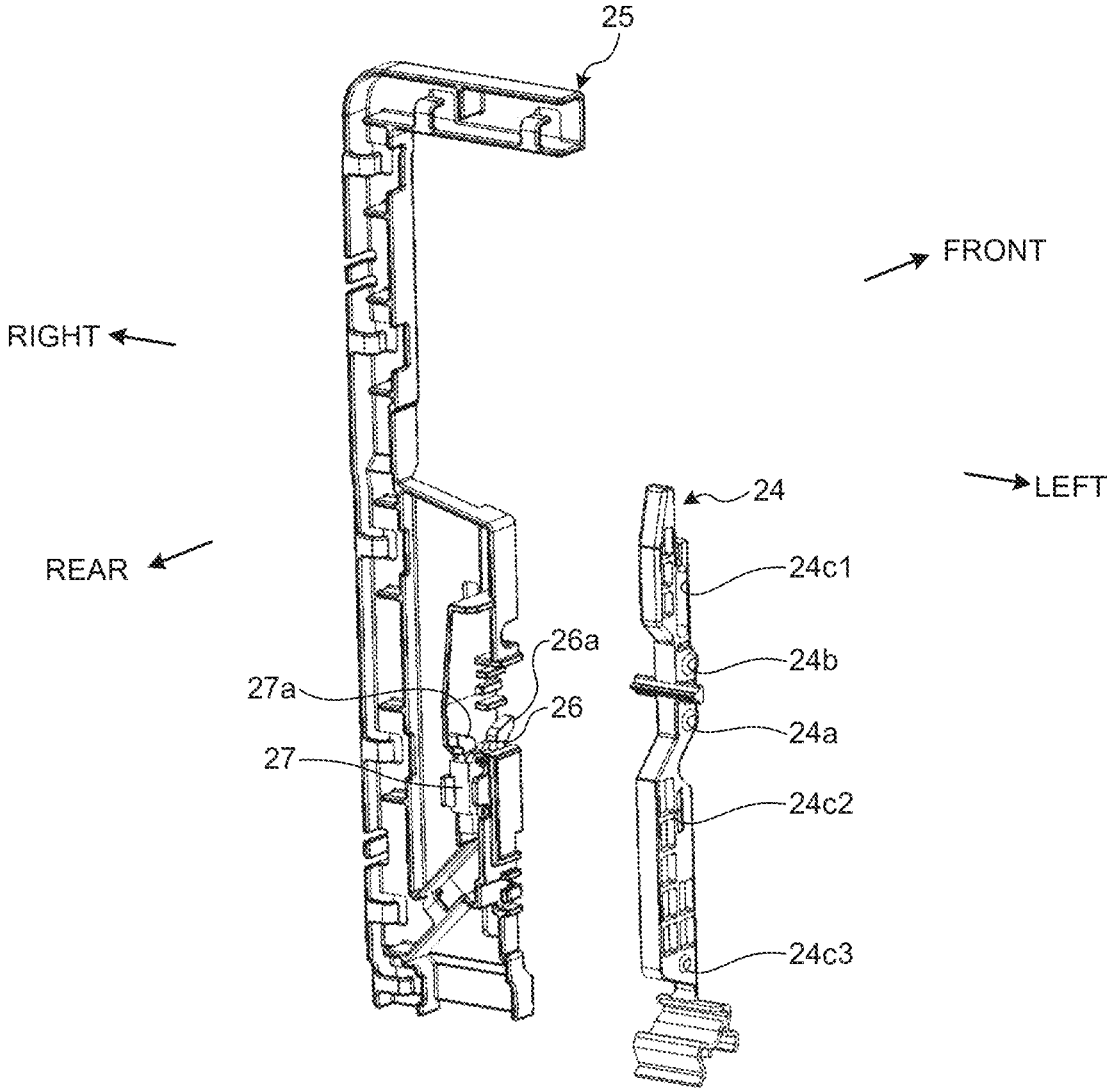
FIG. 10 is a perspective view of a shaft support part and a harness guide mounted on the base illustrated in FIG. 9.

The shaft support part 24 and a harness guide 25 as illustrated in FIG. 10 are mounted on the base 21 having the above configuration. The shaft support part 24 is formed of a resin material or the like and is fitted into between the first right shaft support piece 22*b* and the second left shaft support piece 23*a*.

The harness guide 25 is formed of a resin material or the like similarly to the shaft support part 24 and is fitted along the right side wall 21*a* of the base 21 in such a manner as to being adjacent to the second right shaft support piece 23*b*. This harness guide 25 is for routing a harness of electric parts mounted on the first article discharging apparatus 20*a*. In addition, the harness guide 25 has a role of a guide member when the first article discharging apparatus 20*a* and the second article discharging apparatus 20*b* are combined in a back-to-back manner.

Arranged on the harness guide 25 are a first out-of-stock detection switch 26 and a second out-of-stock detection switch 27.

The first out-of-stock detection switch 26 is arranged so as to be aligned with the second out-of-stock detection switch 27 fore and aft and is positioned on the front side of the second out-of-stock detection switch 27. This first out-of-stock detection switch 26 is what is called a push type switch and includes a contact maker 26*a* biased to be erected by a spring (not illustrated). The first out-of-stock detection switch 26 is turned to an off state (a second state) to send an off signal to a dispensing controller 60 described below with the contact maker 26*a* not pressed and is turned to an on state (a first state) to send an on signal to the dispensing controller 60 when the contact maker 26*a* is pressed to be displaced against the biasing force of the spring.

In the present embodiment, the first out-of-stock detection switch 26 is turned to the off state with the contact maker 26*a* not pressed and is turned to the on state when the contact maker 26*a* is pressed to be displaced; in the disclosure, the first out-of-stock detection switch 26 may be turned to the on state with the contact maker 26*a* not pressed and be turned to the off state when the contact maker 26*a* is pressed to be displaced.

The second out-of-stock detection switch 27 is positioned on the rear side of the first out-of-stock detection switch 26. This second out-of-stock detection switch 27 is what is called a push type switch and includes a contact maker 27*a* biased to be erected by a spring (not illustrated). The second out-of-stock detection switch 27 is turned to an off state (the second state) to send an off signal to the dispensing controller 60 described below with the contact maker 27*a* not pressed and is turned to an on state (the first state) to send an on signal to the dispensing controller 60 when the contact maker 27*a* is pressed to be displaced against the biasing force of the spring.

In the present embodiment, the second out-of-stock detection switch 27 is turned to the off state with the contact maker 27*a* not pressed and is turned to the on state when the contact maker 27*a* is pressed to be displaced; in the disclosure, the second out-of-stock detection switch 27 may be turned to the on state with the contact maker 27*a* not pressed and be turned to the off state when the contact maker 27*a* is pressed to be displaced.

Provided on the base 21 are a first swinging support shaft 28*a* and a second swinging support shaft 29*a*. The first swinging support shaft 28*a* is a shaft-shaped member installed passing through open holes 22*a*1, 22*b*1, 23*a*1, 23*b*1, and 24*a* formed in the first left shaft support piece 22*a*, the first right shaft support piece 22*b*, the second left shaft support piece 23*a*, the second right shaft support piece 23*b*, and the shaft support part 24, respectively, in such a manner as to extend in a substantially horizontal direction and supports the lower pedal 28 in its intermediate part. A first out-of-stock link 30 is arranged at the right end of the first swinging support shaft 28*a*.

The second swinging support shaft 29*a* is a shaft-shaped member installed passing through open holes 22*a*2, 22*b*2, 23*a*2, 23*b*2, and 24*b* formed in the first left shaft support piece 22*a*, the first right shaft support piece 22*b*, the second left shaft support piece 23*a*, the second right shaft support piece 23*b*, and the shaft support part 24, respectively, in such a manner as to extend in the substantially horizontal direction in an area above the first swinging support shaft 28*a* and supports the upper pedal 29 in its intermediate part.

The lower pedal 28 is a plate-shaped member and causes the first swinging support shaft 28*a* to be inserted into its basal end to be thereby arranged in such a manner as to be swingable about the central axis of this first swinging support shaft 28*a*.

A tip of the lower pedal 28 extends in the radially outside direction of the first swinging support shaft 28*a* and can advance and retract to and from the first article storage passage 13*a* through the first insertion hole 22 and the second insertion hole 23 when the lower pedal 28 swings about the central axis of the first swinging support shaft 28*a*. In other words, the lower pedal 28 is arranged swingably in such a manner as to advance and retract to and from the first article storage passage 13*a*.

A lower pedal spring 28*b* is interposed between the lower pedal 28 and the base 21. The lower pedal spring 28*b* always biases the lower pedal 28 in an advancing direction to the first article storage passage 13*a*. More specifically, the lower pedal spring 28*b* sets the lower pedal 28 to a standby attitude (hereinafter, referred to also as an article-absent standby attitude (a second standby attitude)) so as to position the tip of the lower pedal 28 above the first swinging support shaft 28*a* as illustrated in FIG. 6. When an article is placed on the top face of the lower pedal 28, the lower pedal spring 28*b* sets the lower pedal 28 to a standby attitude (hereinafter, referred to also as an article-present standby attitude (a first standby attitude)) so as to position the tip of the lower pedal 28 at a height level equal to the first swinging support shaft 28*a* as illustrated in FIG. 7.

With this operation, the tip of the lower pedal 28 is positioned at an upper position when the lower pedal 28 is in the article-absent standby attitude than when the lower pedal 28 is at the article-present standby attitude.

Figure 11:
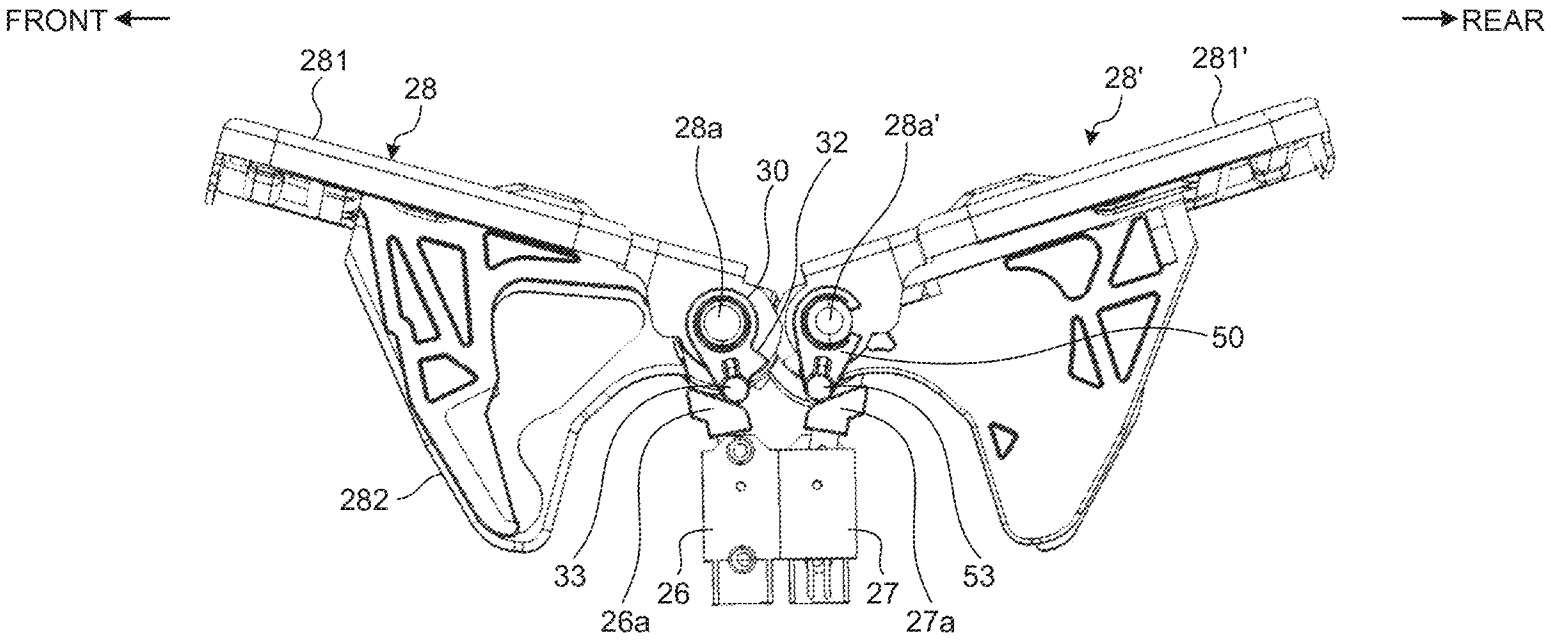
FIG. 11 is a side view of a principal part of the article dispensing apparatus in FIG. 2 to FIG. 4.

When the lower pedal 28 is in the article-absent standby attitude, the basal end 281*a* of the lower pedal 28 comes into contact with a first out-of-stock contact part 32 of the first out-of-stock link 30 as illustrated in FIG. 11, whereby the first out-of-stock link 30 rotates about an axis of the first swinging support shaft 28*a*, whereby a first out-of-stock pressing part 33 presses the contact maker 26*a* of the first out-of-stock detection switch 26. With this operation, the contact maker 26*a* is pressed to be displaced frontward against the biasing force of the spring, whereby the first out-of-stock detection switch 26 is turned to the on state to send the on signal to the dispensing controller 60.

Figure 12:
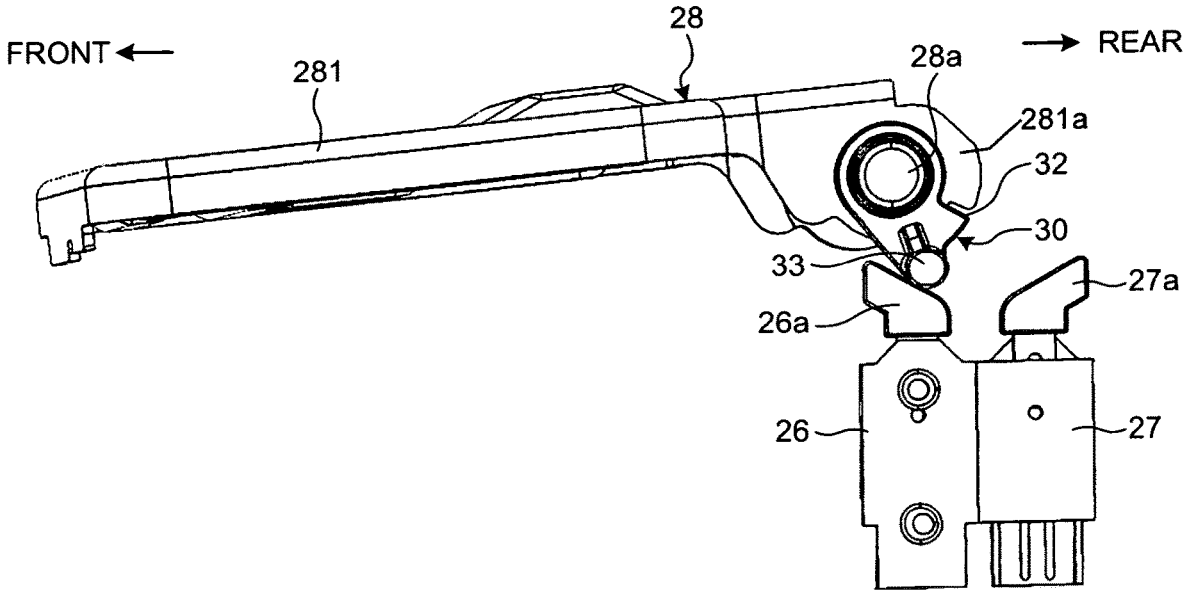
FIG. 12 is a side view of relation between a first out-of-stock link and a first out-of-stock detection switch when a lower pedal has turned to an article-present standby attitude.

In contrast, when the lower pedal 28 is at the article-present standby attitude, the basal end of the lower pedal 28 separates from the first out-of-stock contact part 32 of the first out-of-stock link 30 as illustrated in FIG. 12, whereby the first out-of-stock link 30 becomes free. With this operation, the contact maker 26*a* is biased by the spring to be erected, whereby the first out-of-stock detection switch 26 is turned to the off state to send the off signal to the dispensing controller 60. In other words, the first out-of-stock pressing part 33 is pressed by the contact maker 26*a*, whereby the first out-of-stock link 30 that has become free rotates about the axis of the first swinging support shaft 28*a*.

The lower pedal 28 includes a plate-shaped pedal main body 281 and a pair of guide parts 282. The pair of guide parts 282 are provided on the back side of the pedal main body 281. The guide parts 282 are plate-shaped members extending in the up-and-down direction and are formed so as to face each other. Guide grooves 283 are formed on the facing faces facing each other of the respective guide parts 282.

The guide groove 283 includes a fitted-in part 283*a* that is positioned lowermost and in which a pedal operation shaft 361 of a turning stopper 36 described below is fitted in a state (the state illustrated in FIG. 6) in which the lower pedal 28 is arranged at an advanced position most advanced to the first article storage passage 13*a*, a contact part 283*d* that is positioned uppermost and with which the pedal operation shaft 361 of the turning stopper 36 comes into contact in a state (the state illustrated in FIG. 8) in which the lower pedal 28 is arranged at a retracted position most retracted from the first article storage passage 13*a*, and a first guide part 283*b* and a second guide part 283*c* that connect the fitted-in part 283*a* and the contact part 283*d* so as to make them continuous.

The first guide part 283*b* is formed in the guide part 282 in such a manner as to incline obliquely upward so as to separate from the fitted-in part 283*a* relative to the base 21, to incline obliquely upward so as to be close to the base 21, and to reach the contact part 283*d* in the state in which the lower pedal 28 is arranged at the position (the advanced position) most advanced relative to the first article storage passage 13*a*.

The second guide part 283*c* is formed in the guide part 282 in such a manner as to incline obliquely downward so as to separate from the contact part 283*d* relative to the base 21 and to reach the fitted-in part 283*a* in the state in which the lower pedal 28 is arranged at the position (the advanced position) most advanced to the first article storage passage 13*a*.

The radially outward length of this lower pedal 28 from the first swinging support shaft 28*a* is set to a length that can ensure a gap smaller than the maximum width of an article the maximum width of which is smaller between the lower pedal 28 and the passage width defining plate 16 when the lower pedal 28 is positioned at the position (the advanced position) most advanced to the first article storage passage 13*a*.

The upper pedal 29 is a plate-shaped member and causes the second swinging support shaft 29*a* to be inserted into its basal end to be thereby arranged on the base 21 in such a manner as to be swingable about the central axis of this second swinging support shaft 29*a*.

A tip of the upper pedal 29 extends in the radially outside direction of the second swinging support shaft 29*a* and can advance and retract to and from the first article storage passage 13*a* through the first insertion hole 22 and the second insertion hole 23 when the upper pedal 29 swings about the central axis of the second swinging support shaft 29*a*. In other words, the upper pedal 29 is arranged swingably in such a manner as to advance and retract to and from the first article storage passage 13*a*.

An upper pedal spring (not illustrated) is interposed between the upper pedal 29 and the base 21. The upper pedal spring always biases the upper pedal 29 in a retracting direction from the first article storage passage 13*a*.

The upper pedal 29 includes a pressing inclined face 291, a recess 292, a stopper contact part 293, and a protrusion 294. The pressing inclined face 291 is provided at the tip of the upper pedal 29 and is a curved inclined face formed in such a manner as to gradually lower toward the first article storage passage 13*a* when the upper pedal 29 is retracted from the first article storage passage 13*a*. The recess 292 is provided on the back side of the upper pedal 29 and is a line of recess extending in the substantially horizontal direction formed in such a manner as to open to both side faces of the upper pedal 29. The stopper contact part 293 is a part with which a stopper pin 34*a* described below comes into contact and is provided in such a manner as to incline above the recess 292 on the back side of the upper pedal 29.

The protrusion 294 is provided in such a manner as to protrude at the basal end of the upper pedal 29 toward the first article storage passage 13*a*.

This upper pedal 29 is biased to retract from the first article storage passage 13*a* by the biasing force of the upper pedal spring, and the stopper pin 34*a* comes into contact with the recess 292, whereby an initial position is set to the state in which the upper pedal 29 has retracted from the first article storage passage 13*a*.

This upper pedal 29 is inclined forward relative to a vertical plane passing through the second swinging support shaft 29*a* in a state (the state illustrated in FIG. 8) in which the upper pedal 29 is positioned at a position (an advanced position) most advanced to the first article storage passage 13*a*. The radially outward length of the upper pedal 29 from the second swinging support shaft 29*a* is set to a length that can ensure a gap smaller than the maximum width of an article the maximum width of which is smaller between the upper pedal 29 and the passage width defining plate 16 in the forward inclined state.

In the base 21, installed between the shaft support part 24 and the second right shaft support piece 23*b* are the stopper pin 34*a*, a pedal stopper pin 34*b*, and a stopper shaft 34*c*.

The stopper pin 34*a* is a shaft-shaped member arranged in the substantially horizontal direction between the shaft support part 24 and the second right shaft support piece 23*b*, one end of which is inserted into a stopper pin insertion hole 23*b*3 of the second right shaft support piece 23*b*, whereas the other end of which is inserted into a stopper pin insertion hole 24*c*1 of the shaft support part 24 exposed out of the second left shaft support piece 23*a*. This stopper pin 34*a* is connected to a pedal link 35 and can move in the up-and-down direction inside the stopper pin insertion holes 23*b*3 and 24*c*1 along with the movement in the up-and-down direction of the pedal link 35. The stopper pin 34*a* is in contact with the recess 292 of the upper pedal 29 in the initial position.

The pedal stopper pin 34*b* is a shaft-shaped member arranged in the substantially horizontal direction between the shaft support part 24 and the second right shaft support piece 23*b*, one end of which is inserted into a pedal stopper pin support groove 24*c*2 (an elongated groove extending up and down similar to the stopper pin insertion hole 24*c*1, is blocked by a groove bottom as a drawer part of the reference symbol 24*c*1, and is invisible in FIG. 6) of the shaft support part 24, whereas the other end of which is inserted into a pedal stopper pin support groove 23*b*4 of the second right shaft support piece 23*b*. An insertion groove 23*a*4 is provided in the second left shaft support piece 23*a* so as to expose the pedal stopper pin support groove 24*c*2. This pedal stopper pin 34*b* is connected to the pedal link 35 and can move in the up-and-down direction inside the pedal stopper pin support grooves 23*b*4 and 24*c*2 along with the movement in the up-and-down direction of the pedal link 35. The periphery of this pedal stopper pin 34*b* slides within the pedal stopper pin support grooves 23*b*4 and 24*c*2 when the pedal link 35 is moved in the up-and-down direction.

The stopper shaft 34*c* is a shaft-shaped member arranged in the substantially horizontal direction between the shaft support part 24 and the second right shaft support piece 23*b*, one end of which is inserted into a stopper shaft insertion hole 24*c*3 of the shaft support part 24, whereas the other end of which is inserted into an open hole 23*b*5 of the second right shaft support piece 23*b*. An insertion hole for the stopper shaft 34*c* is formed in the second left shaft support piece 23*a*. This stopper shaft 34*c* supports the turning stopper 36 in its intermediate part.

The turning stopper 36 causes the stopper shaft 34*c* to be inserted into its insertion hole of its basal end and is arranged between the shaft support part 24 and the second right shaft support piece 23*b* in such a manner as to be swingable about the central axis of this stopper shaft 34*c*.

A tip of the turning stopper 36 extends in the radially outside direction of the stopper shaft 34*c* and can advance and retract to and from the first article storage passage 13*a* through the second insertion hole 23 when the turning stopper 36 swings about the central axis of the stopper shaft 34*c*.

This turning stopper 36 causes the pedal operation shaft 361 to be inserted into an open hole 36*a* of the tip and thereby has the pedal operation shaft 361. The pedal operation shaft 361 is a shaft-shaped member arranged in the substantially horizontal direction, both ends of which are fitted in the guide grooves 283 of the lower pedal 28.

A pedal operation spring (not illustrated) is interposed between the turning stopper 36 and the base 21. The pedal operation spring always biases the turning stopper 36 in an advancing direction to the first article storage passage 13*a*.

This turning stopper 36 is biased in an advancing direction to the first article storage passage 13*a* by the pedal operation spring and is prevented from moving in a retracting direction by the pedal stopper pin 34*b* entering an indentation 36*b* of the turning stopper 36 and coming into contact with the pedal stopper pin 34*b*, and an initial position with the turning stopper 36 advanced to the first article storage passage 13*a* is set. The lower pedal 28 is biased by the lower pedal spring 28*b*, whereby the turning stopper 36 positions both ends of the pedal operation shaft 361 at the fitted-in parts 283*a* of the guide grooves 283 and sets an initial position at a position at which the lower pedal 28 has advanced to the first article storage passage 13*a*.

The pedal link 35 is an elongated plate-shaped member extending in the up-and-down direction, in which an upper part is bent frontward and then extends upward. Provided on the upper part of this pedal link 35 are a contact piece 351 that extends rearward and then extends obliquely upward and a locking part 352 that locks a link spring 35*a*. This link spring 35*a* is interposed between the pedal link 35 and the base 21 and always biases the pedal link 35 downward.

With the pedal link 35 biased by the link spring 35*a* and arranged at a lower position, the stopper pin 34*a* is arranged at the lower end of the stopper pin insertion holes 23*b*3 and 24*c*1, whereas the pedal stopper pin 34*b* is arranged at the lower end of the pedal stopper pin support grooves 23*b*4 and 24*c*2. In this state, the recess 292 of the upper pedal 29 arranged at the retracted position is in contact with the stopper pin 34*a*. Besides, the turning stopper 36 arranged at the advanced position is in contact with the pedal stopper pin 34*b*, thereby preventing the turning stopper 36 from retracting. In addition, the pedal operation shaft 361 of the turning stopper 36 arranged at the advanced position is fitted in the fitted-in parts 283*a* of the lower pedal 28, thereby preventing the lower pedal 28 arranged at the advanced position from retracting.

In contrast, with the pedal link 35 arranged at an upper position against the biasing force of the link spring 35*a*, as illustrated in FIG. 8, the stopper pin 34*a* is arranged at the upper end of the stopper pin insertion holes 23*b*3 and 24*c*1, whereas the pedal stopper pin 34*b* is arranged at the upper end of the pedal stopper pin support grooves 23*b*4 and 24*c*2. In this state, the stopper contact part 293 of the upper pedal 29 is in contact with the stopper pin 34*a*, thereby preventing the upper pedal 29 from retracting and causing the upper pedal 29 to advance against the biasing force of the upper pedal spring and to be arranged at the advanced position.

Meanwhile, the prevention of retracting for the turning stopper 36 by the pedal stopper pin 34*b* is released, and the prevention of retracting is released about the stopper shaft 34*c*. The load of the article in contact with the lower pedal 28 maintained at the advanced position by the turning stopper 36 is being applied to the turning stopper 36, and the prevention of retracting has been released, whereby the turning stopper 36 starts retracting. When the retracting of the turning stopper 36 is started, the pedal operation shaft 361 is detached from the fitted-in parts 283*a* of the lower pedal 28, whereby the lower pedal 28 is allowed to retract about the first swinging support shaft 28*a* and retracts against the elastic biasing force of the lower pedal spring 28*b* by the load of the article (refer to FIG. 8).

Figure 13:
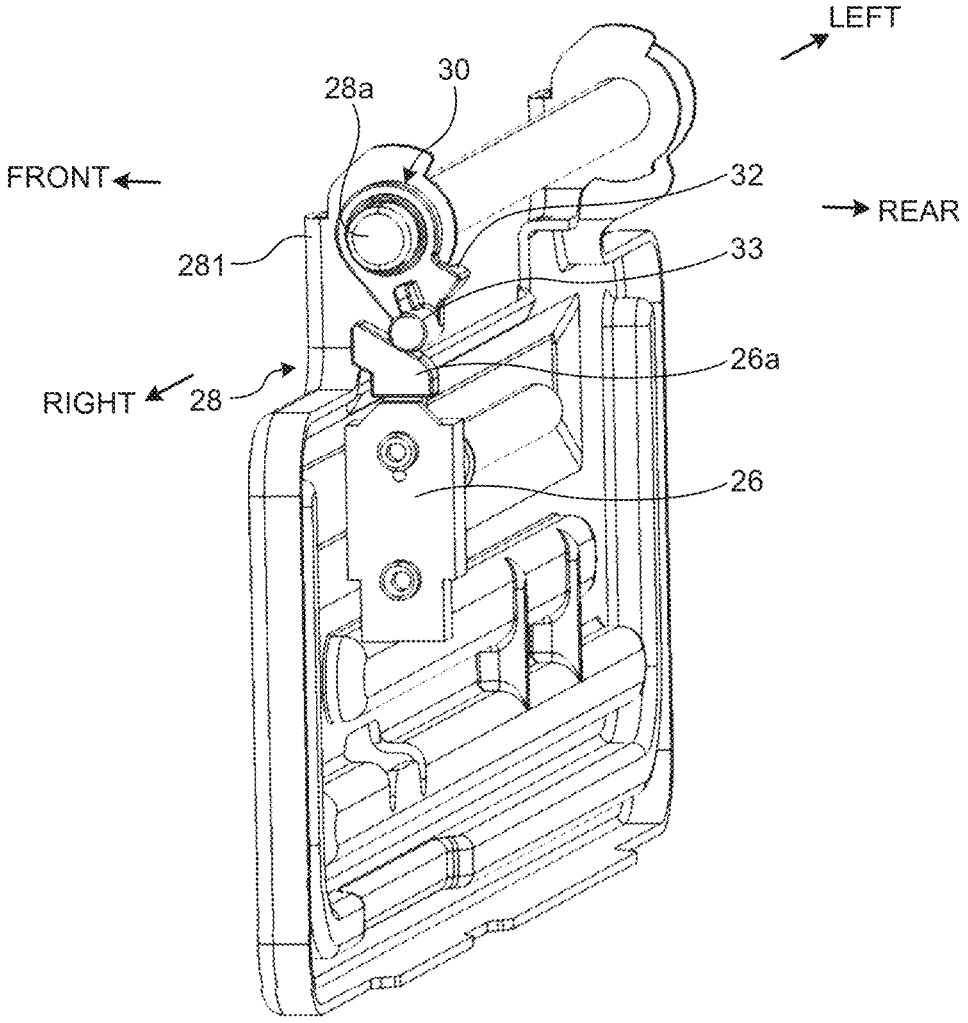
FIG. 13 is a perspective view of relation between the first out-of-stock link and the first out-of-stock detection switch when the lower pedal has retracted.

When the lower pedal 28 thus retracts, the basal end of the lower pedal 28 separates from the first out-of-stock contact part 32 of the first out-of-stock link 30 as illustrated in FIG. 13, whereby the first out-of-stock link 30 becomes free. With this operation, the contact maker 26*a* is pressed by the spring to be erected, whereby the first out-of-stock detection switch 26 maintains the off state. In other words, also when the lower pedal 28 retracts similarly to the article-present standby attitude, the first out-of-stock link 30 does not press the contact maker 26*a* of the first out-of-stock detection switch 26.

The first article discharging apparatus 20*a* having such a configuration includes a driving unit 40 in addition to the above configuration.

Figure 14:
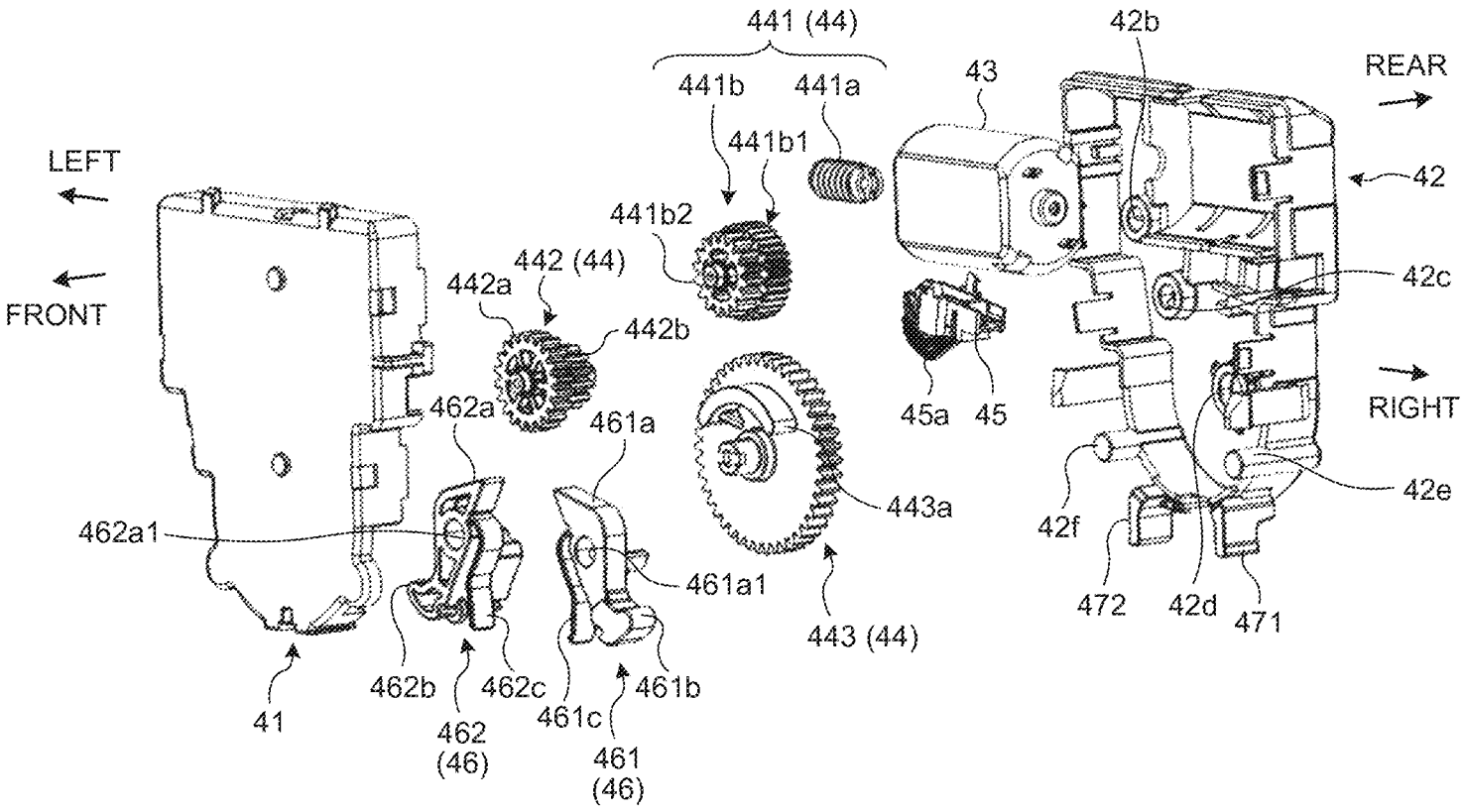
FIG. 14 is an exploded perspective view of a principal part of a driving unit in the first article discharging apparatus when viewed from the right front.
Figure 15:
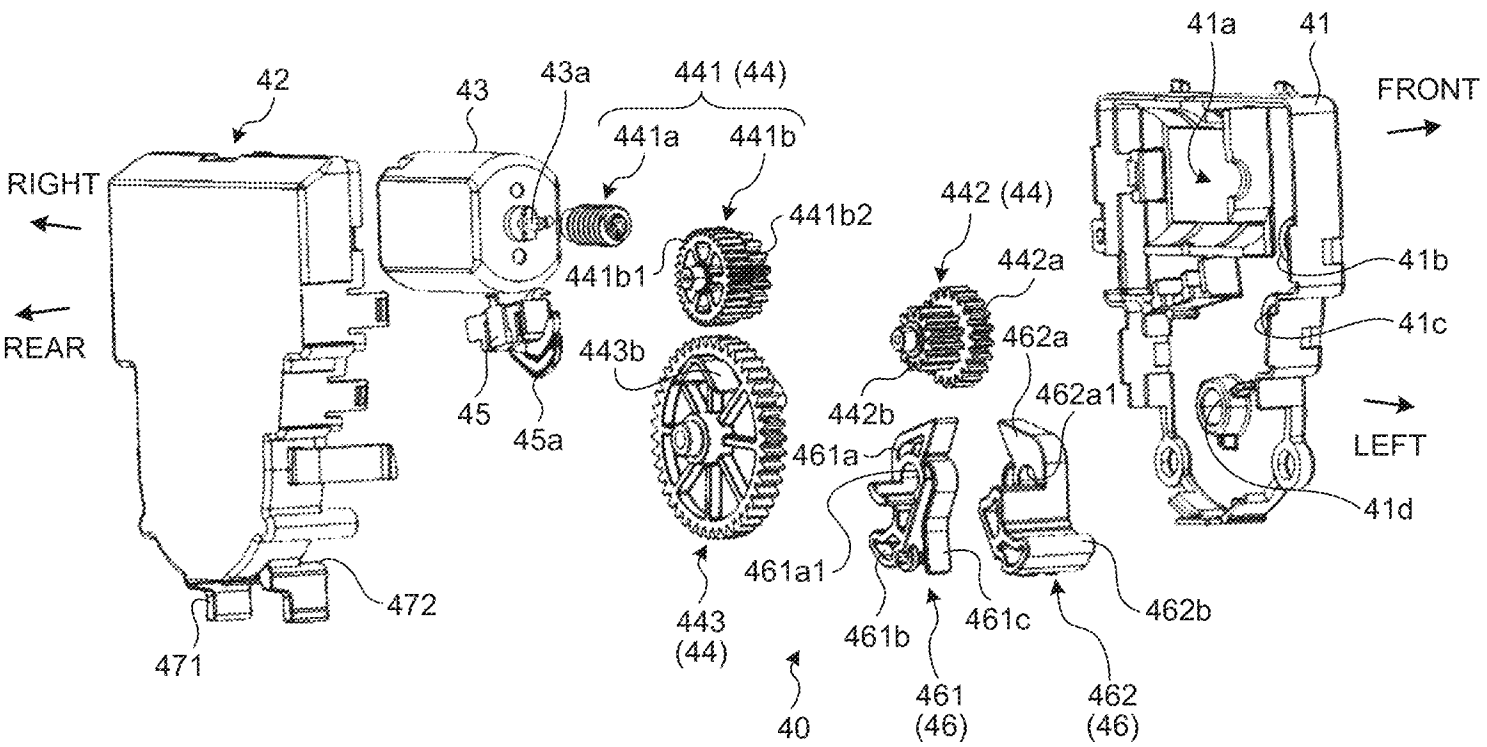
FIG. 15 is an exploded perspective view of the principal part of the driving unit in the first article discharging apparatus when viewed from the left rear.

FIG. 14 and FIG. 15 illustrate a principal part of the driving unit 40 in the first article discharging apparatus 20*a*: FIG. 14 is an exploded perspective view when viewed from the right front; and FIG. 15 is an exploded perspective view when viewed from the left rear.

The driving unit 40 is arranged at the central area at the upper part on the back side of the base 21. This driving unit 40 includes a unit base 41 mounted on the back side of the base 21.

The unit base 41 is formed of a resin material, for example, and is formed in a box shape with its rear face open. The unit base 41 blocks the rear opening by mounting a unit cover 42 formed of resin to form a housing space between the unit base 41 and the unit cover 42. Housed in the housing space thus formed by the unit base 41 and the unit cover 42 are a motor 43, a gear member 44, a carrier switch 45, and a link lever 46.

The motor 43 is a driving source and is a forward-and-backward rotatable direct-current (DC) motor that is driven in accordance with an instruction given from the dispensing controller 60 described below. The motor 43 is arranged by being held by a motor holding part 41*a* of the unit base 41.

The gear member 44 includes a worm gear 441, an intermediate gear 442, and an output gear (an output member) 443. The worm gear 441 has a worm 441*a* and a worm wheel 441*b*.

The worm 441*a* is formed in a cylindrical shape and is mounted on an output shaft 43*a* of the motor 43. The worm wheel 441*b* has a disc-shaped first worm wheel 441*b*1 and a disc-shaped second worm wheel 441*b*2.

The first worm wheel 441*b*1 is formed with a shaft-shaped part protruding rearward at its central part and is formed with a gear part including a plurality of teeth on its periphery.

The second worm wheel 441*b*2 is positioned on the front side of the first worm wheel 441*b*1 and is formed with a shaft-shaped part the central axis of which is aligned with the central axis of the shaft-shaped part of the first worm wheel 441*b*1 in such a manner as to protrude frontward. The periphery of this second worm wheel 441*b*2 is also formed with a gear part including a plurality of teeth.

This worm wheel 441*b* is arranged rotatably about the central axis of the shaft-shaped part by, with the gear part of the first worm wheel 441*b*1 engaged with the worm 441*a*, inserting the shaft-shaped part into recesses 41*b* and 42*b* of the unit base 41 and the unit cover 42, respectively.

The intermediate gear 442 has a disc-shaped first intermediate gear 442*a* and a disc-shaped second intermediate gear 442*b*. The first intermediate gear 442*a* is formed with a shaft-shaped part protruding rearward at its central part and is formed with a gear part including a plurality of teeth on its periphery.

The second intermediate gear 442*b* is positioned on the rear side of the first intermediate gear 442*a* and is formed with a shaft-shaped part the central axis of which is aligned with the central axis of the shaft-shaped part of the first intermediate gear 442*a* in such a manner as to protrude frontward. The periphery of this second intermediate gear 442*b* is also formed with a gear part including a plurality of teeth.

This intermediate gear 442 is arranged rotatably about the central axis of the shaft-shaped part by, with the gear part of the first intermediate gear 442*a* engaged with the gear part of the second worm wheel 441*b*2, inserting the shaft-shaped part into recesses 41*c* and 42*c* of the unit base 41 and the unit cover 42, respectively.

The output gear 443 is formed in a disc shape having an enlarged diameter compared with those of the worm wheel 441*b* and the intermediate gear 442. The periphery of this output gear 443 is also formed with a plurality of teeth. The output gear 443 is formed with a shaft-shaped part protruding in a fore-and-aft direction at its central part. Further, the output gear 443 is formed with a cam part 443*a* on its front face and is formed with a pressing piece 443*b* on its rear face.

The cam part 443*a* is formed in an arc shape and is formed in such a manner as to protrude frontward. This cam part 443*a* is formed such that its arc length will be large enough to, after the pedal link 35 is moved upward, maintain that state.

The pressing piece 443*b* is formed in a substantially V shape and is formed in such a manner as to protrude rearward on the rear face as a face that is opposite the cam part 443*a*.

This output gear 443 is arranged rotatably about the central axis of the shaft-shaped part by, with the gear part engaged with the gear part of the second intermediate gear 442*b*, inserting the shaft-shaped part into recesses 41*d* and 42*d* of the unit base 41 and the unit cover 42, respectively.

The carrier switch 45 is what is called a push type switch and includes a contact maker 45*a*. This carrier switch 45 is arranged on the unit base 41 held at a slightly upper position than the area on which the output gear 443 is arranged. This carrier switch 45 is turned to an on state when the contact maker 45*a* is pressed and gives the fact as an on signal to the dispensing controller 60 and is turned to an off state when the contact maker 45*a* is not pressed and gives the fact as an off signal to the dispensing controller 60.

The link lever 46 includes a first link lever 461 and a second link lever 462. The first link lever 461 is formed of a resin material, for example, and is formed with an open hole 461*a*1 in a basal end 461*a*. This first link lever 461 is formed in a hook shape in which a tip 461*b* extends right downward from the basal end 461*a* and then curves right upward. In addition, a locking part 461*c* is provided on the basal end 461*a* of the first link lever 461. The locking part 461*c* is an elastically deformable, plate-shaped elastic member extending downward from the left end of the basal end 461*a*.

A first link shaft 42*e* provided in the unit cover 42 is inserted into the open hole 461*a*1 of the basal end 461*a*, whereby the first link lever 461 is arranged rotatably about the central axis of the first link shaft 42*e* on the front side of the output gear 443. In this case, the first link lever 461 passes through a right opening (not illustrated) formed by the unit base 41 and the unit cover 42, and the tip 461*b* is positioned outside the unit base 41 and the unit cover 42. The locking part 461*c* comes into contact with a left side edge 471 of the right opening, thereby determining the attitude of the first link lever 461 in the normal state.

The second link lever 462 is formed of a resin material, for example, and is formed with an open hole 462*a*1 in a basal end 462*a*. This second link lever 462 is formed in a hook shape in which a tip 462*b* extends left downward from the basal end 462*a* and then curves left upward. The tip 462*b* of this second link lever 462 is larger in fore-and-aft width than the tip 461*b* of the first link lever 461. Further, a locking part 462*c* is provided on the basal end 462*a* of the second link lever 462. The locking part 462*c* is an elastically deformable, plate-shaped elastic member extending downward from the right end of the basal end 462*a*.

A second link shaft 42*f* provided in the unit cover 42 is inserted into the open hole 462*a*1 of the basal end 462*a*, whereby the second link lever 462 is arranged rotatably about the central axis of the second link shaft 42*f* on the front side of the output gear 443. In this case, the second link lever 462 passes through a left opening (not illustrated) formed by the unit base 41 and the unit cover 42, and the tip 462*b* is positioned outside the unit base 41 and the unit cover 42.

The locking part 462*c* comes into contact with a right side edge 472 of the left opening, thereby determining the attitude of the second link lever 462 in the normal state.

Figure 16:
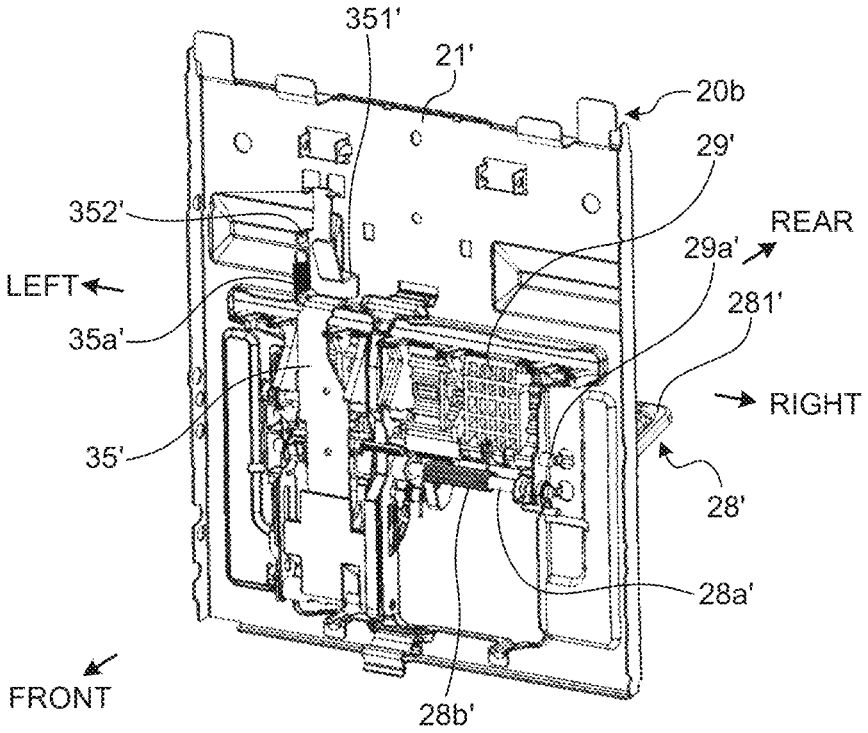
FIG. 16 is a perspective view when viewing a second article discharging apparatus illustrated in FIG. 2 to FIG. 4 from the right front.
Figure 17:
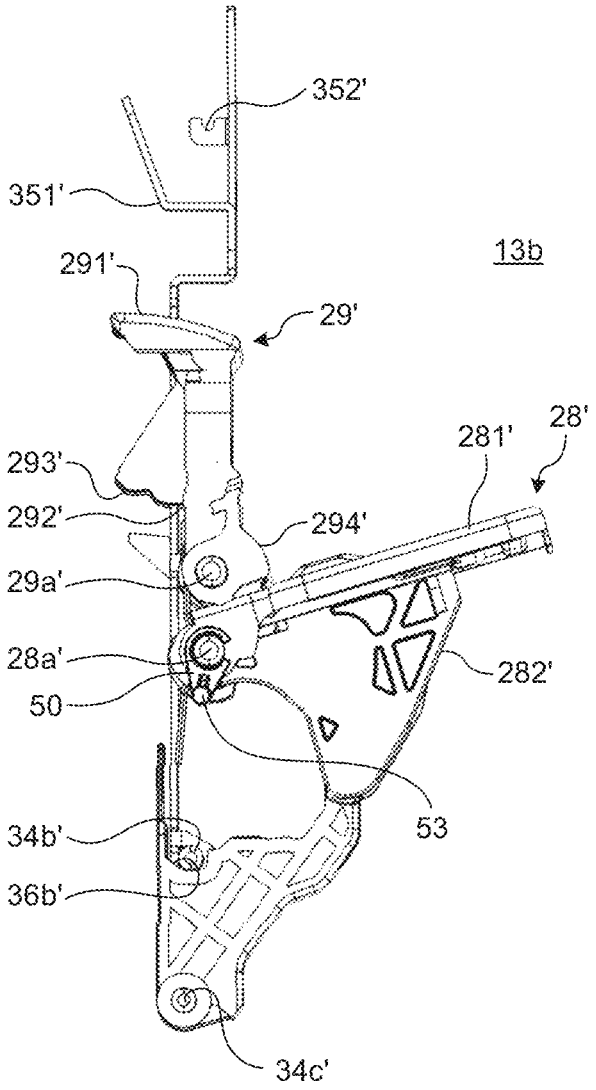
FIG. 17 is a schematic illustrative diagram when viewing a principal part of the second article discharging apparatus illustrated in FIG. 2 to FIG. 4 and FIG. 16 from the right.

FIG. 16 is a perspective view when viewing the second article discharging apparatus 20*b* illustrated in FIG. 2 to FIG. 4 from the right front. FIG. 17 is a schematic illustrative diagram when viewing a principal part of the second article discharging apparatus 20*b* illustrated in FIG. 2 to FIG. 4 and FIG. 16 from the right. Most of the components of the second article discharging apparatus 20*b* are common to the components of the first article discharging apparatus 20*a* and are different in fore-and-aft orientation from the components of the first article discharging apparatus 20*a* and are opposite in the right-and-left direction. Given this situation, the second article discharging apparatus 20*b* will be described simply with illustration omitted as appropriate and with "'" attached to the symbols attached in the first article discharging apparatus 20*a* for components common to the components of the first article discharging apparatus 20*a* among the components of the second article discharging apparatus 20*b*.

The second article discharging apparatus 20*b* is used for the second article storage passage 13*b* and is arranged at the lower part of this second article storage passage 13*b*. This second article discharging apparatus 20*b* controls the behavior of articles between the second article discharging apparatus 20*b* and a passage width defining plate 17 facing it, thereby functioning to store the articles in the second article storage passage 13*b* in a discharge standby state and to discharge a corresponding article one by one to the article chute 5 when being driven and includes a base 21'.

Figure 18:
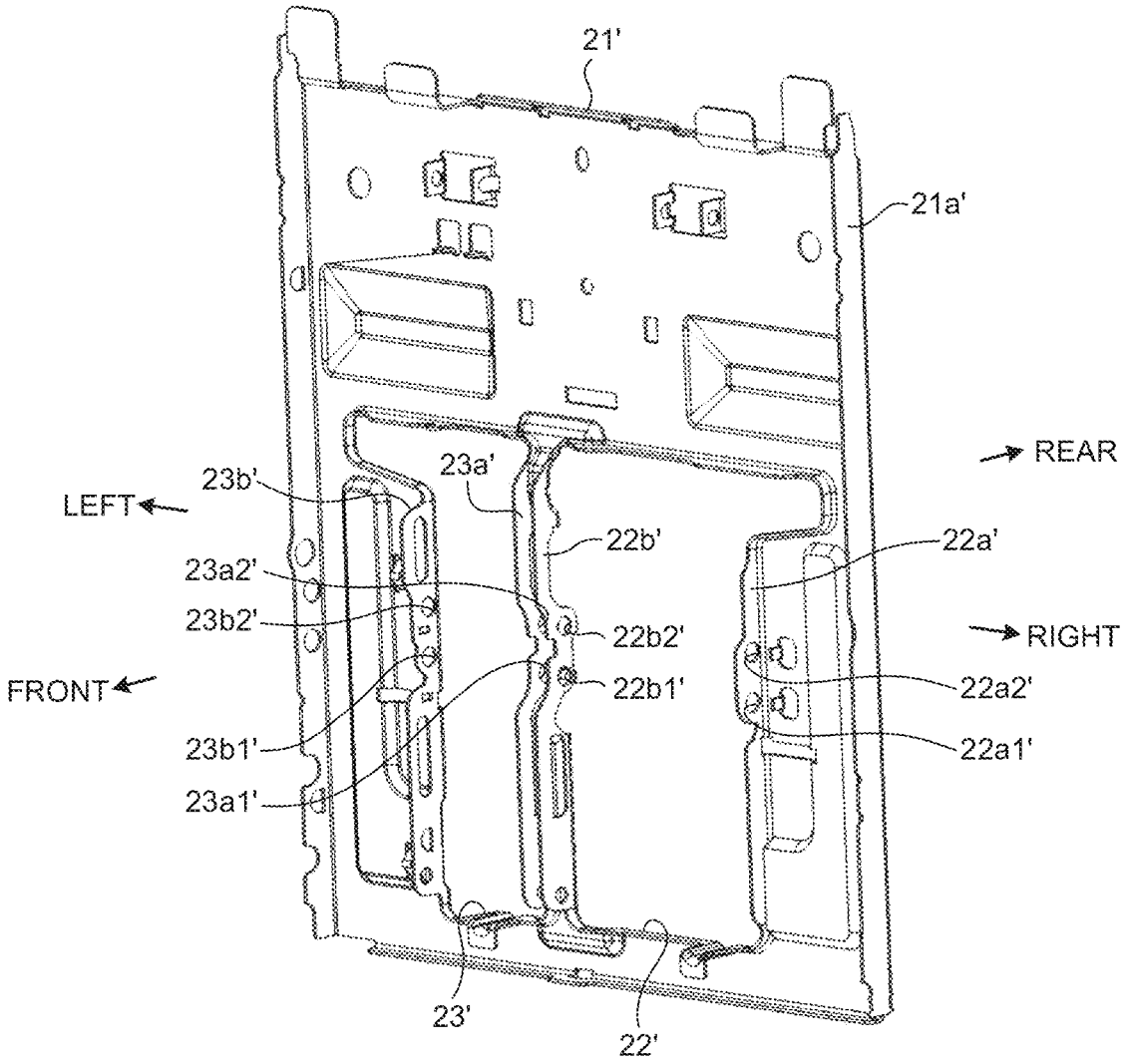
FIG. 18 is a perspective view of a base of the second article discharging apparatus illustrated in FIG. 16.

As illustrated in FIG. 18, the base 21' is formed by performing cutting and bending on a steel sheet and is arranged in such a manner as to cause its surface to face the passage width defining plate 17. This base 21' is formed with side walls 21*a*' by causing its both ends to be bent and is formed with a first insertion hole 22' and a second insertion hole 23' in its intermediate part. The peripheries of the first insertion hole 22' and the second insertion hole 23' are bent similarly to the side walls 21*a*' to form flanges.

The first insertion hole 22' and the second insertion hole 23' are formed so as to be next to each other right and left and have the same up-and-down dimension. As to the first insertion hole 22' and the second insertion hole 23', the first insertion hole 22' is positioned on the right side of the second insertion hole 23', and the right-and-left width of the first insertion hole 22' is larger than the right-and-left width of the second insertion hole 23'. The first insertion hole 22' and the second insertion hole 23' are both through openings (recesses causing a lower pedal 28' and an upper pedal 29' described below to retract to within the base 21') formed in a substantially rectangular shape as a whole; the upper end of the first insertion hole 22' protrudes rightward, whereas the upper end of the second insertion hole 23' protrudes leftward. A first right shaft support piece 22*a*' is provided on the right side edge of the first insertion hole 22', whereas a first left shaft support piece 22*b*' is provide on the left side edge of the first insertion hole 22'; a second right shaft support piece 23*a*' is provided on the right side edge of the second insertion hole 23', whereas a second left shaft support piece 23*b*' is provided on the left side edge of the second insertion hole 23'. The first left shaft support piece 22*b*' and the second right shaft support piece 23*a*' correspond to the flanges formed on the peripheries of the first insertion hole 22' and the second insertion hole 23'. The first left shaft support piece 22*b*' and the second right shaft support piece 23*a*' are formed in shaft inserting flanges forming U-shaped both leg pieces in a shaft support holding part that is formed integrally with the base 21' and is formed to have a U-shaped transverse cross section (discontinuous) that holds a shaft support part 24' described below in a fitted manner. This shaft support holding part has a function of maintaining the strength of the base 21' also when a large through opening including the first insertion hole 22' and the second insertion hole 23' formed in a substantially rectangular shape as a whole is formed in the base 21'.

Figure 19:
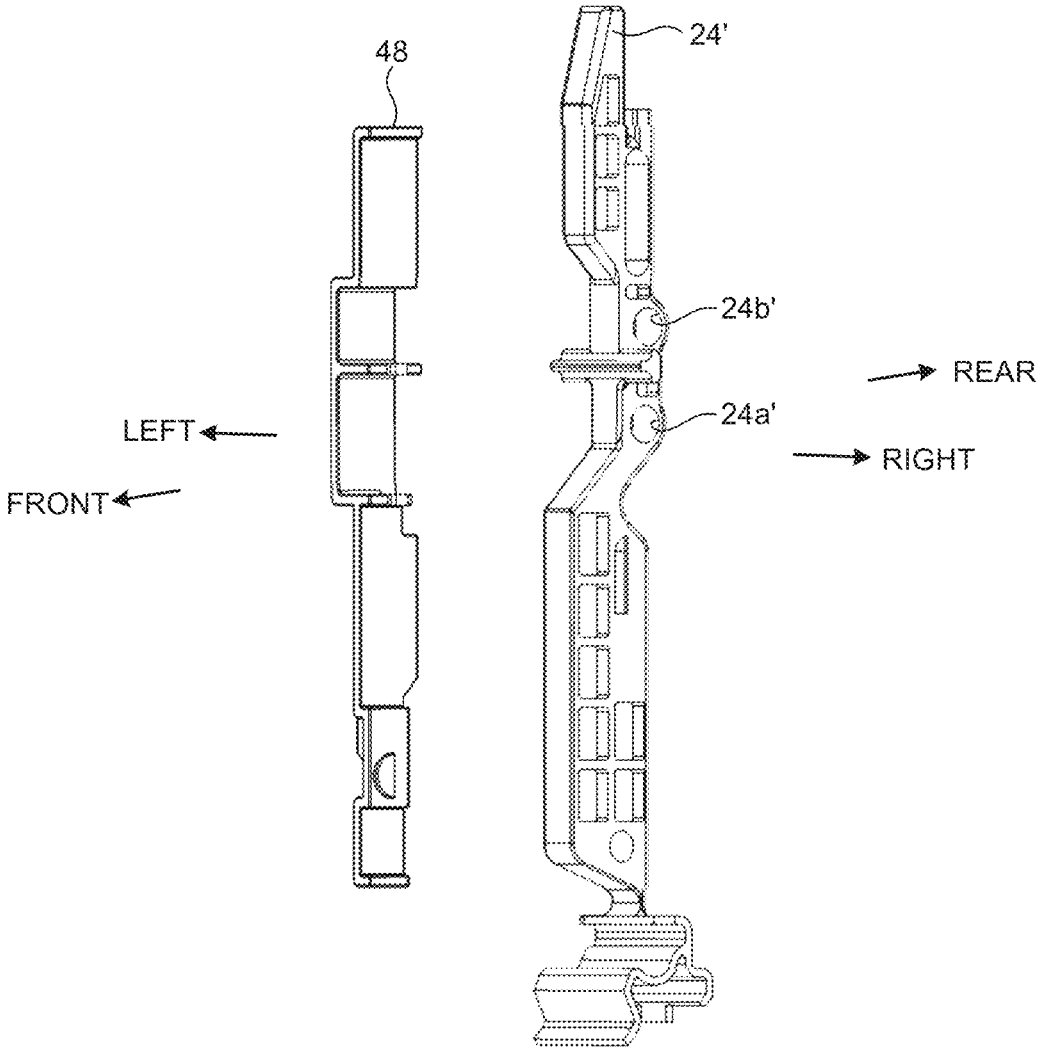
FIG. 19 is a perspective view of a shaft support part and a guide mounted on the base illustrated in FIG. 18.

The shaft support part 24' and a guide 48 as illustrated in FIG. 19 are mounted on the base 21' having the above configuration. The shaft support part 24' is formed of a resin material or the like and is fitted into between the first left shaft support piece 22*b*' and the second right shaft support piece 23*a*'. The guide 48 is formed of a resin material or the like similarly to the shaft support part 24' and is fitted to the base 21' in such a manner as to be adjacent to the second left shaft support piece 23*b*'.

Provided on the base 21' are a first swinging support shaft 28*a*' and a second swinging support shaft 29*a*'. The first swinging support shaft 28*a*' is a shaft-shaped member installed passing through open holes 22*a*1', 22*b*1', 23*a*1', 23*b*1', and 24*a*' formed in the first right shaft support piece 22*a*', the first left shaft support piece 22*b*', the second right shaft support piece 23*a*', the second left shaft support piece 23*b*', and the shaft support part 24', respectively, in such a manner as to extend in the substantially horizontal direction and supports the lower pedal 28' in its intermediate part.

A second out-of-stock link 50 is arranged at the right end of the first swinging support shaft 28*a*'. The second out-of-stock link 50 includes a second out-of-stock base and a second out-of-stock contact part, which are not illustrated, and a second out-of-stock pressing part 53 (refer to FIG. 11). The second out-of-stock base is formed by coupling lower ends of two C-shaped, disc-shaped parts by a coupling part, for example, in which open holes through which the right end of the first swinging support shaft 28*a*' is passed are formed in the respective disc-shaped members. The second out-of-stock contact part extends leftward than a forward part of the left disc-shaped part of the second out-of-stock base. This second out-of-stock contact part is provided on the left side of the first out-of-stock contact part 32 included in the first out-of-stock link 30, thereby causing them not to interfere with each other. The second out-of-stock pressing part 53 is formed so as to protrude rightward than a lower part of the right disc-shaped part of the second out-of-stock base. The open holes formed in the second out-of-stock base are formed larger than the first swinging support shaft 28*a*', thereby enabling the second out-of-stock link 50 to move freely relative to the first swinging support shaft 28*a*'.

The second swinging support shaft 29*a*' is a shaft-shaped member installed passing through open holes 22*a*2', 22*b*2', 23*a*2', 23*b*2', and 24*b*' formed in the first right shaft support piece 22*a*', the first left shaft support piece 22*b*', the second right shaft support piece 23*a*', the second left shaft support piece 23*b*', and the shaft support part 24', respectively, in such a manner as to extend in the substantially horizontal direction in an area above the first swinging support shaft 28*a*' and supports the upper pedal 29' in its intermediate part.

The lower pedal 28' is a plate-shaped member and causes the first swinging support shaft 28*a*' to be inserted into its basal end to be arranged in such a manner as to be swingable about the central axis of this first swinging support shaft 28*a*'.

A tip of the lower pedal 28' extends in the radially outside direction of the first swinging support shaft 28*a*' and can advance and retract to and from the second article storage passage 13*b* through the first insertion hole 22' and the second insertion hole 23' when the lower pedal 28' swings about the central axis of the first swinging support shaft 28*a*'. In other words, the lower pedal 28' is arranged swingably in such a manner as to advance and retract to and from the second article storage passage 13*b*.

A lower pedal spring 28*b*' is interposed between the lower pedal 28' and the base 21'. The lower pedal spring 28*b*' always biases the lower pedal 28' in an advancing direction to the second article storage passage 13*b*. More specifically, the lower pedal spring 28*b*' sets the lower pedal 28' to a standby attitude (hereinafter, referred to also as an article-absent standby attitude (the second standby attitude)) so as to position the tip of the lower pedal 28' above the first swinging support shaft 28*a*' as illustrated in FIG. 17. When an article is placed on the top face of the lower pedal 28', the lower pedal spring 28*b*' sets the lower pedal 28' to a standby attitude (hereinafter, referred to also as an article-present standby attitude (the first standby attitude)) so as to position the tip of the lower pedal 28' at a height level equal to the first swinging support shaft 28*a*'.

With this operation, the tip of the lower pedal 28' is positioned at an upper position when the lower pedal 28' is in the article-absent standby attitude than when the lower pedal 28' is at the article-present standby attitude.

When the lower pedal 28' is in the article-absent standby attitude, the basal end of the lower pedal 28' comes into contact with the second out-of-stock contact part of the second out-of-stock link 50 as illustrated in FIG. 11, whereby the second out-of-stock link 50 rotates about an axis of the first swinging support shaft 28*a*', whereby the second out-of-stock pressing part 53 presses the contact maker 27*a* of the second out-of-stock detection switch 27. With this operation, the contact maker 27*a* is pressed to be displaced rearward against the biasing force of the spring, whereby the second out-of-stock detection switch 27 is turned to the on state to send the on signal to the dispensing controller 60.

In contrast, when the lower pedal 28' is at the article-present standby attitude, the basal end of the lower pedal 28' separates from the second out-of-stock contact part of the second out-of-stock link 50, whereby the second out-of-stock link 50 becomes free. With this operation, the contact maker 27*a* is biased by the spring to be erected, whereby the second out-of-stock detection switch 27 is turned to the off state to send the off signal to the dispensing controller 60. In other words, the second out-of-stock pressing part 53 is pressed by the contact maker 27*a*, whereby the second out-of-stock link 50 that has become free rotates about an axis of the first swinging support shaft 28*a*'.

The lower pedal 28' includes a plate-shaped pedal main body 281' and a pair of guide parts 282'. The pair of guide parts 282' are provided on the back side of the pedal main body 281'. The guide parts 282' are plate-shaped members extending in the up-and-down direction and are formed so as to face each other. Guide grooves (not illustrated) are formed on the facing faces facing each other of the respective guide parts 282'.

The guide groove includes a fitted-in part that is positioned lowermost and in which a pedal operation shaft 361' (refer to FIG. 4) of a turning stopper 36' described below is fitted in a state in which the lower pedal 28' is arranged at an advanced position most advanced to the second article storage passage 13*b*, a contact part that is positioned uppermost and with which the pedal operation shaft 361' of the turning stopper 36' comes into contact in a state in which the lower pedal 28' is arranged at a retracted position most retracted from the second article storage passage 13*b*, and a first guide part and a second guide part that connect the fitted-in part and the contact part so as to make them continuous.

The first guide part is formed in the guide part 282' in such a manner as to incline obliquely upward so as to separate from the fitted-in part relative to the base 21', to incline obliquely upward so as to be close to the base 21', and to reach the contact part in the state in which the lower pedal 28' is arranged at a position (an advanced position) most advanced relative to the second article storage passage 13*b*.

The second guide part is formed in the guide part 282' in such a manner as to incline obliquely downward so as to separate from the contact part relative to the base 21' and to reach the fitted-in part in the state in which the lower pedal 28' is arranged at the position (the advanced position) most advanced to the second article storage passage 13*b*.

The radially outward length of this lower pedal 28' from the first swinging support shaft 28*a*' is set to a length that can ensure a gap smaller than the maximum width of an article the maximum width of which is smaller between the lower pedal 28' and the passage width defining plate 17 when the lower pedal 28' is positioned at the position (the advanced position) most advanced to the second article storage passage 13*b*.

The upper pedal 29' is a plate-shaped member and causes the second swinging support shaft 29*a*' to be inserted into its basal end to be thereby arranged on the base 21' in such a manner as to be swingable about the central axis of this second swinging support shaft 29*a*'.

A tip of the upper pedal 29' extends in the radially outside direction of the second swinging support shaft 29*a*' and can advance and retract to and from the second article storage passage 13*b* through the first insertion hole 22' and the second insertion hole 23' when the upper pedal 29' swings about the central axis of the second swinging support shaft 29*a*'. In other words, the upper pedal 29' is arranged swingably in such a manner as to advance and retract to and from the second article storage passage 13*b*.

An upper pedal spring (not illustrated) is interposed between the upper pedal 29' and the base 21'. The upper pedal spring always biases the upper pedal 29' in a retracting direction from the second article storage passage 13*b*.

The upper pedal 29' includes a pressing inclined face 291', a recess 292', a stopper contact part 293', and a protrusion 294'. The pressing inclined face 291' is provided at the tip of the upper pedal 29' and is a curved inclined face formed in such a manner as to gradually lower toward the second article storage passage 13*b* when the upper pedal 29' is retracted from the second article storage passage 13*b*. The recess 292' is provided on the back side of the upper pedal 29' and is a line of recess extending in the substantially horizontal direction formed in such a manner as to open to both side faces of the upper pedal 29'. The stopper contact part 293' is a part with which a stopper pin described below comes into contact and is provided in such a manner as to incline above the recess 292' on the back side of the upper pedal 29'.

The protrusion 294' is provided in such a manner as to protrude at the basal end of the upper pedal 29' toward the second article storage passage 13*b*.

This upper pedal 29' is biased to retract from the second article storage passage 13*b* by the biasing force of the upper pedal spring, and the stopper pin comes into contact with the recess 292', whereby an initial position is set to the state in which the upper pedal 29' has retracted from the second article storage passage 13*b*.

This upper pedal 29' is inclined forward relative to a vertical plane passing through the second swinging support shaft 29*a*' in a state in which the upper pedal 29' is positioned at a position (an advanced position) most advanced to the second article storage passage 13*b*. The radially outward length of the upper pedal 29' from the second swinging support shaft 29*a*' is set to a length that can ensure a gap smaller than the maximum width of an article the maximum width of which is smaller between the upper pedal 29' and the passage width defining plate 17 in the forward inclined state.

In the base 21', installed between the shaft support part 24' and the second left shaft support piece 23*b*' are the stopper pin (not illustrated), a pedal stopper pin 34*b*', and a stopper shaft 34*c*'.

The stopper pin is a shaft-shaped member arranged in the substantially horizontal direction between the shaft support part 24' and the second left shaft support piece 23*b*'. This stopper pin is connected to a pedal link 35' and can move in the up-and-down direction along with the movement in the up-and-down direction of the pedal link 35'. The stopper pin is in contact with the recess 292' of the upper pedal 29' in the initial position.

The pedal stopper pin 34*b*' is a shaft-shaped member arranged in the substantially horizontal direction between the shaft support part 24' and the second left shaft support piece 23*b*'. This pedal stopper pin 34*b*' is connected to a pedal link 35' and can move in the up-and-down direction along with the movement in the up-and-down direction of the pedal link 35'.

The stopper shaft 34*c*' is a shaft-shaped member arranged in the substantially horizontal direction between the shaft support part 24' and the second left shaft support piece 23*b*' and supports the turning stopper 36' in its intermediate part.

The turning stopper 36' causes the stopper shaft 34*c*' to be inserted into its insertion hole of its basal end and is arranged between the shaft support part 24' and the second left shaft support piece 23*b*' in such a manner as to be swingable about the central axis of this stopper shaft 34*c*'.

A tip of the turning stopper 36' extends in the radially outside direction of the stopper shaft 34*c*' and can advance and retract to and from the second article storage passage 13*b* through the second insertion hole 23' when the turning stopper 36' swings about the central axis of the stopper shaft 34*c*'.

This turning stopper 36' causes the pedal operation shaft 361' (refer to FIG. 4) to be inserted into an open hole (not illustrated) of the tip and thereby has the pedal operation shaft 361'. The pedal operation shaft 361' is a shaft-shaped member arranged in the substantially horizontal direction, both ends of which are fitted in the guide grooves of the lower pedal 28'.

A pedal operation spring (not illustrated) is interposed between the turning stopper 36' and the base 21'. The pedal operation spring always biases the turning stopper 36' in an advancing direction to the second article storage passage 13*b*.

This turning stopper 36' is biased in an advancing direction to the second article storage passage 13*b* by the pedal operation spring and is prevented from moving in a retracting direction by the pedal stopper pin 34*b*' entering an indentation 36*b*' of the turning stopper 36' and coming into contact with the pedal stopper pin 34*b*', and an initial position with the turning stopper 36' advanced to the second article storage passage 13*b* is set. The lower pedal 28' is biased by the lower pedal spring 28*b*', whereby the turning stopper 36' positions both ends of the pedal operation shaft 361' at the fitted-in parts of the guide grooves and sets an initial position at a position at which the lower pedal 28' has advanced to the second article storage passage 13*b*.

The pedal link 35' is an elongated plate-shaped member extending in the up-and-down direction, in which an upper part is bent rearward and then extends upward. Provided on the upper part of this pedal link 35' are a contact piece 351' that extends frontward and then extends obliquely upward and a locking part 352' that locks a link spring 35*a*'. This link spring 35*a*' is interposed between the pedal link 35' and the base 21' and always biases the pedal link 35' downward.

With the pedal link 35' biased by the link spring 35*a*' and arranged at a lower position, the recess 292' of the upper pedal 29' arranged at the retracted position is in contact with the stopper pin. Besides, the turning stopper 36' arranged at the advanced position is in contact with the pedal stopper pin 34*b*', thereby preventing the turning stopper 36 from retracting. In addition, the pedal operation shaft 361' of the turning stopper 36' arranged at the advanced position is fitted in the fitted-in parts of the lower pedal 28', thereby preventing the lower pedal 28' arranged at the advanced position from retracting.

In contrast, with the pedal link 35' arranged at an upper position against the biasing force of the link spring 35*a*', the stopper contact part 293' of the upper pedal 29' is in contact with the stopper pin, thereby preventing the upper pedal 29' from retracting and causing the upper pedal 29' to advance against the biasing force of the upper pedal spring and to be arranged at the advanced position.

Meanwhile, the prevention of retracting for the turning stopper 36' by the pedal stopper pin 34*b*' is released, and the prevention of retracting is released about the stopper shaft 34*c*'. The load of the article in contact with the lower pedal 28' maintained at the advanced position by the turning stopper 36' is being applied to the turning stopper 36', and the prevention of retracting for the turning stopper 36' has been released, whereby the turning stopper 36' starts retracting. When the retracting of the turning stopper 36' is started, the pedal operation shaft 361' is detached from the fitted-in parts of the lower pedal 28', whereby the lower pedal 28' is allowed to retract about the first swinging support shaft 28*a*' and retracts against the elastic biasing force of the lower pedal spring 28*b*' by the load of the article.

When the lower pedal 28' thus retracts, the basal end of the lower pedal 28' separates from the second out-of-stock contact part of the second out-of-stock link 50, whereby the second out-of-stock link 50 becomes free. With this operation, the contact maker 27*a* is pressed by the spring to be erected, whereby the second out-of-stock detection switch 27 maintains the off state. In other words, also when the lower pedal 28' retracts similarly to the article-present standby attitude, the second out-of-stock link 50 does not press the contact maker 27*a* of the second out-of-stock detection switch 27.

The first article discharging apparatus 20*a* and the second article discharging apparatus 20*b* having the above configuration are combined in a back-to-back manner with the harness guide 25 as a guide member to form the article dispensing apparatus 20. In this case, the tip of the first link lever 461 included in the driving unit 40 is positioned at a lower area of the contact piece 351 of the pedal link 35, whereas the tip of the second link lever 462 is positioned at a lower area of the contact piece 351' of the pedal link 35'.

Figure 20:
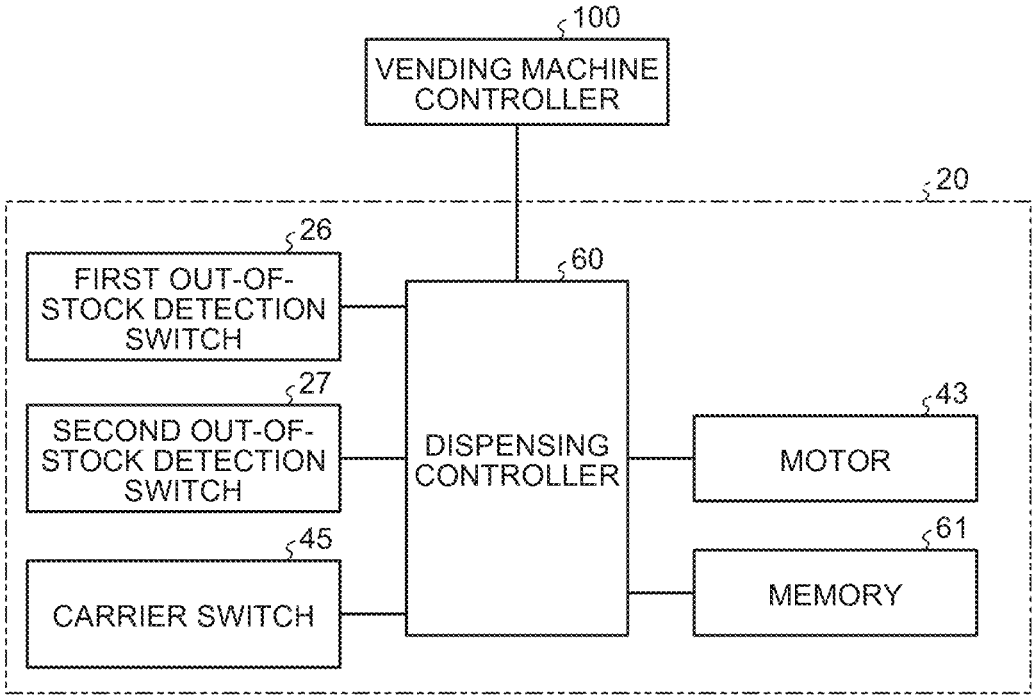
FIG. 20 is a block diagram of a characteristic control system of the article dispensing apparatus.

FIG. 20 is a block diagram of a characteristic control system of the article dispensing apparatus 20. As illustrated in FIG. 20, the article dispensing apparatus 20 includes the dispensing controller 60.

The dispensing controller 60 comprehensively controls the operation of the article dispensing apparatus 20 in accordance with computer programs and data stored in a memory 61 and is communicable with a vending machine controller 100 that controls the selling operation of the vending machine. Processing that this dispensing controller 60 performs will be described below.

The article dispensing apparatus 20 configured as described above in the standby state is as follows. In the following description, an article stored in the first article storage passage 13*a* will be referred to also as a "first article," whereas an article stored in the second article storage passage 13*b* will be referred to also as a "second article."

In the driving unit 40 provided in the first article discharging apparatus 20*a*, the cam part 443*a* and the pressing piece 443*b* of the output gear 443 are positioned uppermost, and the pressing piece 443*b* is pressing the contact maker 45*a* of the carrier switch 45. In this case, the carrier switch 45 is turned to the on state. In this standby state, the tip 461*b* of the first link lever 461 included in the driving unit 40 is at a position separate from the contact piece 351 of the pedal link 35 downward, whereas the tip 462*b* of the second link lever 462 is at a position separate from the contact piece 351' of the pedal link 35' downward.

Given this situation, in the first article discharging apparatus 20*a*, the pedal link 35 is arranged at the lower position as illustrated in FIG. 5. Articles are charged into the first article storage passage 13*a*, and an article is placed on the upper face of the lower pedal 28, whereby the lower pedal 28 is at the article-present standby attitude, and the upper pedal 29 has retracted from the first article storage passage 13*a* (refer to FIG. 23A). The lower pedal 28 is thus at the article-present standby attitude, and the contact maker 26*a* is erected, whereby the first out-of-stock detection switch 26 is turned to the off state.

Figure 24A:
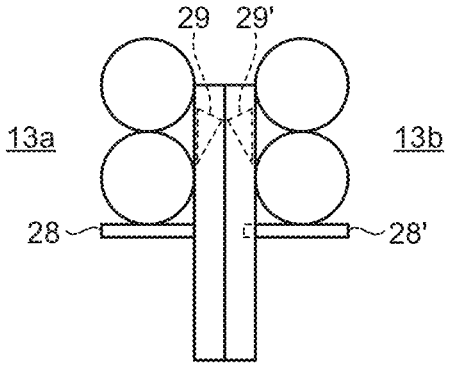
FIG. 24A to FIG. 24D are schematic illustrative diagrams of a discharging procedure of an article by the second article discharging apparatus.

In the second article discharging apparatus 20*b*, the pedal link 35' is positioned at the lower position, the lower pedal 28' is at the article-present standby attitude, and the upper pedal 29' has retracted from the second article storage passage 13*b* (refer to FIG. 24A). The lower pedal 28' is thus at the article-present standby attitude, and the contact maker 27*a* is elected, whereby the second out-of-stock detection switch 27 is turned to the off state.

In this article dispensing apparatus 20, the dispensing controller 60, if having performed input processing on a discharging instruction for the first article given from the vending machine controller 100, drives the motor 43 forward.

When the motor 43 is thus driven forward, the output gear 443 to which the driving force of the motor 43 has been transmitted via the worm gear 441 and the intermediate gear 442 rotates clockwise when viewed from the front.

When the output gear 443 rotates clockwise when viewed from the front, the pressing piece 443*b* of the output gear 443 separates from the contact maker 45*a* of the carrier switch 45. With this operation, the contact maker 45*a* of the carrier switch 45 is released from the pressed state to be switched from the on state to the off state, and the off signal is given to the dispensing controller 60.

Figure 21:
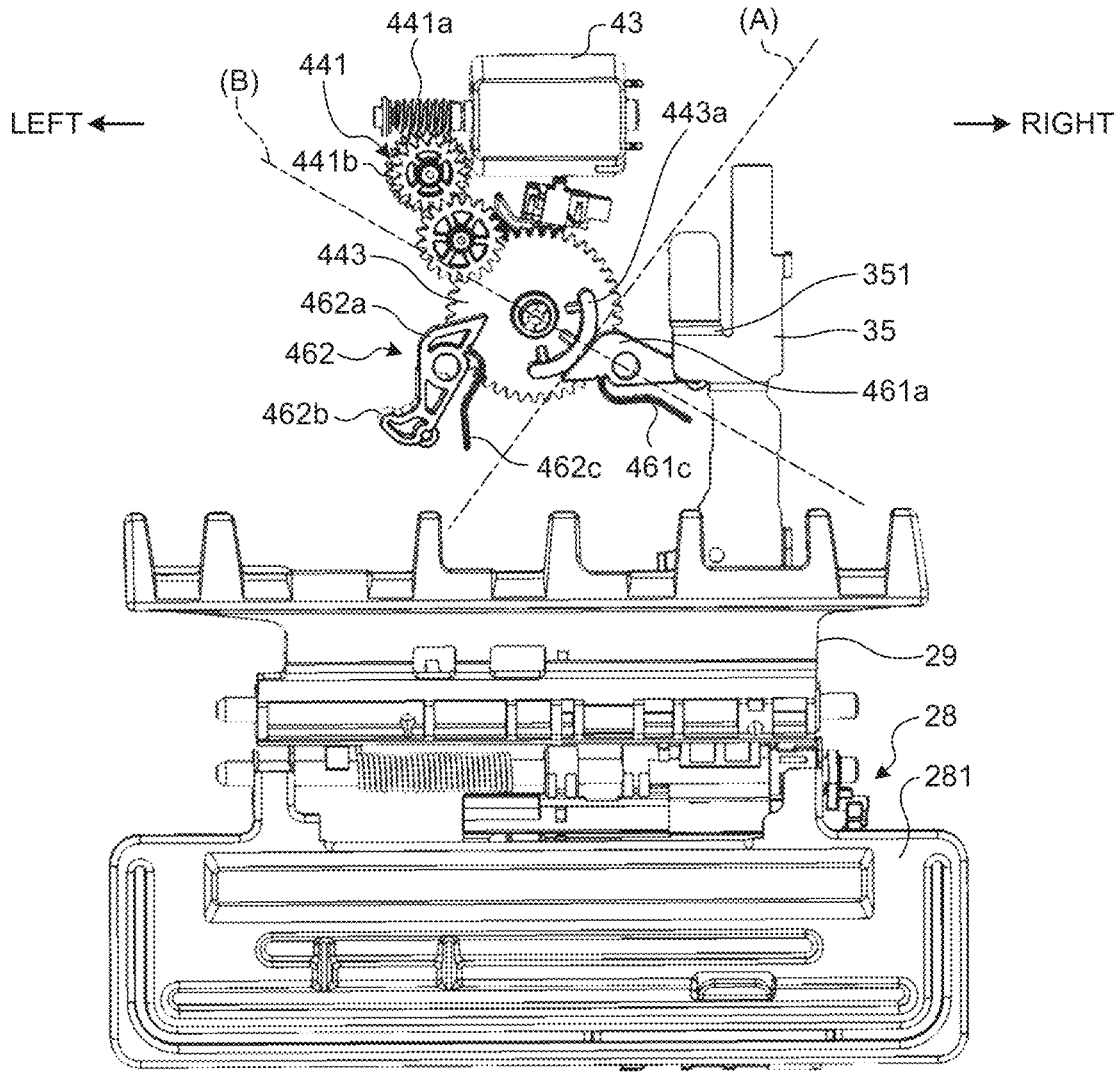
FIG. 21 is an illustrative diagram when viewing the operation of the principal part of the driving unit from the front.
Figure 22:
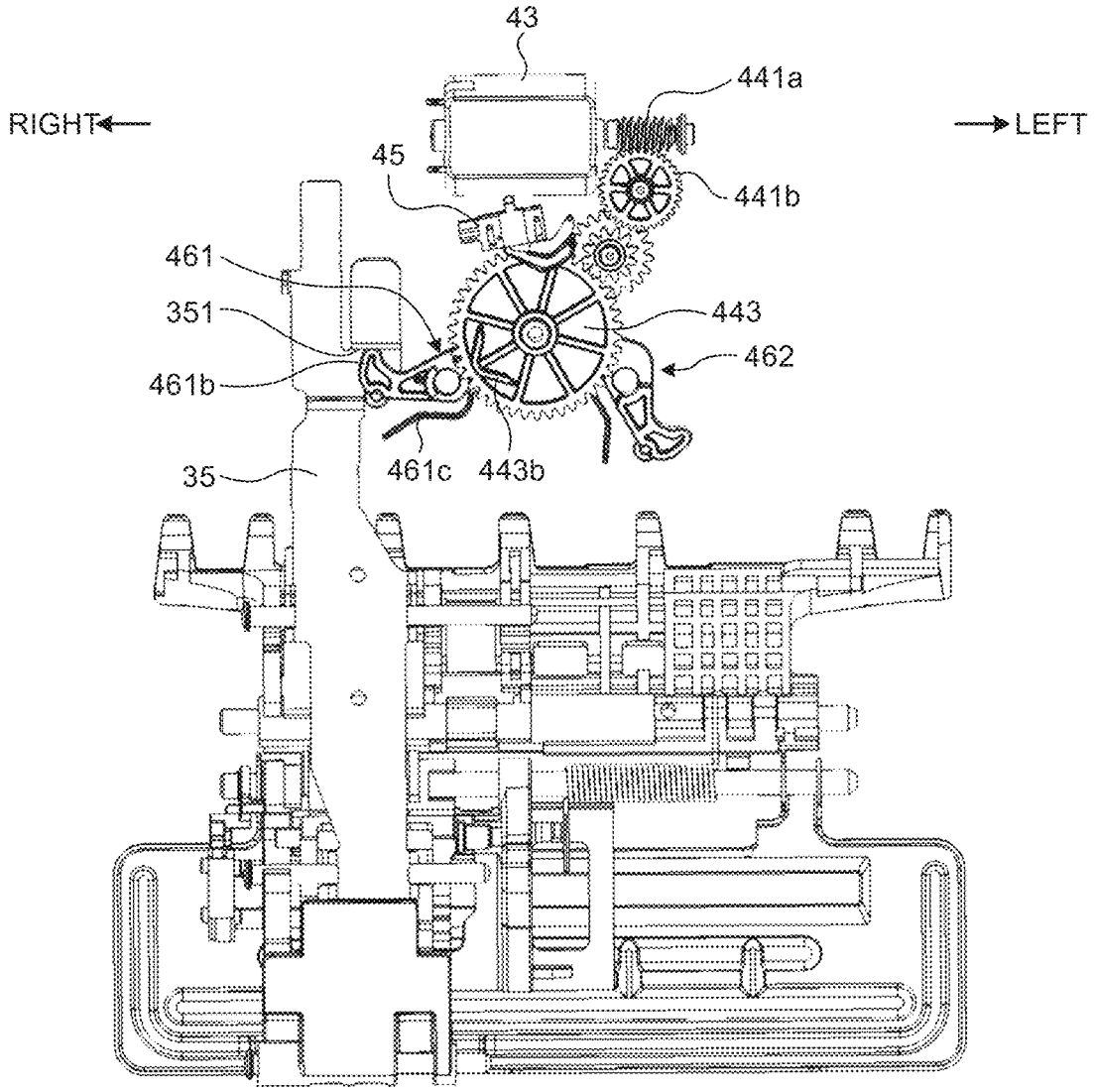
FIG. 22 is an illustrative diagram when viewing the operation of the principal part of the driving unit from the rear squarely.

When the cam part 443*a* comes into contact with the basal end 461*a* of the first link lever 461 from above by the rotation of the output gear 443, the first link lever 461 rotates counterclockwise when viewed from the front. When this first link lever 461 rotates counterclockwise, the tip 461*b* moves upward. The tip 461*b* thus moves upward to come into contact with the contact piece 351 of the pedal link 35 as illustrated in FIG. 21 and FIG. 22, can move the pedal link 35 upward by a certain distance against the biasing force of the link spring 35*a*, and can besides maintain the state in which the pedal link 35 has been moved upward by the certain distance while the cam part 443*a* is in sliding contact with the basal end 461*a*.

In this case, the first link lever 461, when being in sliding contact with the cam part 443*a*, is adjusted so as to cause a plane (A) containing a part in sliding contact with the cam part 443*a* to be substantially orthogonal to a plane (B) containing its own central axis (the central axis of the first link shaft 42*e*) and the central axis of the output gear 443.

Along with this upward movement of the pedal link 35, the stopper pin 34*a* moves upward from the lower end of the stopper pin insertion holes 23*b*3 and 24*c*1, and the pedal stopper pin 34*b* moves upward from the lower end of the pedal stopper pin support grooves 23*b*4 and 24*c*2.

Figure 23A:
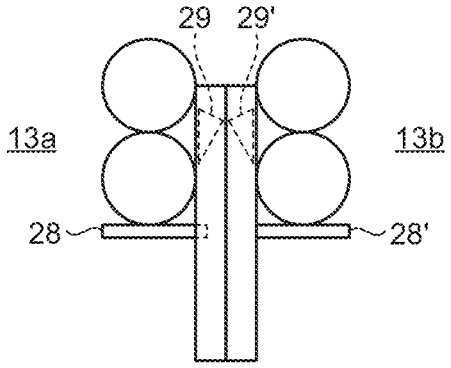
FIG. 23A to FIG. 23D are schematic illustrative diagrams of a discharging procedure of an article by the first article discharging apparatus.
Figure 23B:
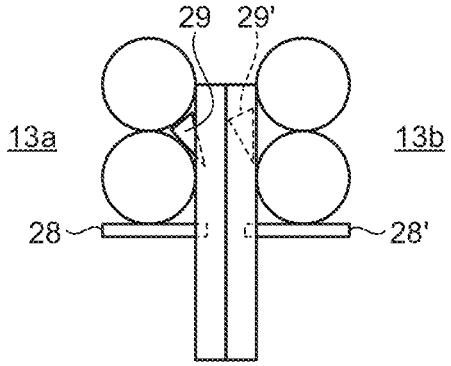

In this process, the stopper pin 34*a* moves upward while being in contact with the edge wall of the recess 292 of the upper pedal 29, whereby the upper pedal 29 advances from the initial position against the biasing force of the upper pedal spring as illustrated in FIG. 23B. This advancing of the upper pedal 29 is performed by the upward movement of the stopper pin 34*a*. When reaching the upper end of the stopper pin insertion holes 23*b*3 and 24*c*1, the stopper pin 34*a* comes into contact with the stopper contact part 293 to prevent the upper pedal 29 from retracting.

The upper pedal 29 that has advanced comes into contact with the second lowermost first article (hereinafter, referred to also as a next article) to prevent the next article from moving downward.

Meanwhile, the load of the article in contact with the lower pedal 28 maintained at the advanced position is being applied to the turning stopper 36, and the prevention of retracting has been released by the upward movement of the pedal stopper pin 34*b*, whereby the turning stopper 36 starts retracting.

When the turning stopper 36 thus starts retracting, the pedal operation shaft 361 escapes from the fitted-in part 283*a*, and the lower pedal 28 starts retracting against the biasing force of the lower pedal spring 28*b* by the self-weight of the article. The pedal operation shaft 361 of the turning stopper 36 that has escaped from the fitted-in part 283*a* moves toward a position at which the first guide part 283*b* and the second guide part 283*c* cross each other along the first guide part 283*b*.

Figure 23C:
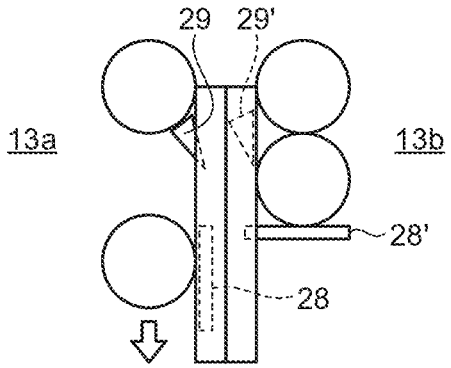

After that, as illustrated in FIG. 23C, the lower pedal 28 retracts by the self-weight of the lowermost article, the lowermost article is allowed to move downward, and the lowermost article is discharged downward (refer to FIG. 8). The discharged article is guided to the article discharging port 3*c* via the article chute 5 and is further enabled to be taken out via the article outlet port 2*a*.

When the lowermost article slips through the lower pedal 28, the lower pedal 28 moves toward the advanced position by the elastic biasing force of the lower pedal spring 28*b*, and the turning stopper 36 also moves toward the advanced position by the elastic biasing force of the pedal operation spring. When the lower pedal 28 and the turning stopper 36 move toward the advanced position, the pedal operation shaft 361 that has been maintained at the position at which the first guide part 283*b* and the second guide part 283*c* cross each other moves toward the fitted-in part 283*a* along the second guide part 283*c*, and the lower pedal 28 and the turning stopper 36 return to the advanced position.

Meanwhile, the pedal link 35 moves upward, the stopper pin 34*a* is positioned at the upper end of the stopper pin insertion holes 23*b*3 and 24*c*1, and the pedal stopper pin 34*b* is positioned at the upper end of the pedal stopper pin support grooves 23*b*4 and 24*c*2.

After that, when the contact between the cam part 443*a* and the basal end 462*a* is released by the rotation of the output gear 443, the pedal link 35 is biased by the link spring 35*a* to move downward.

By this downward movement of the pedal link 35, the stopper pin 34*a* moves downward from the upper end of the stopper pin insertion holes 23*b*3 and 24*c*1, and the pedal stopper pin 34*b* moves downward from the upper end of the pedal stopper pin support grooves 23*b*4 and 24*c*2.

Figure 23D:
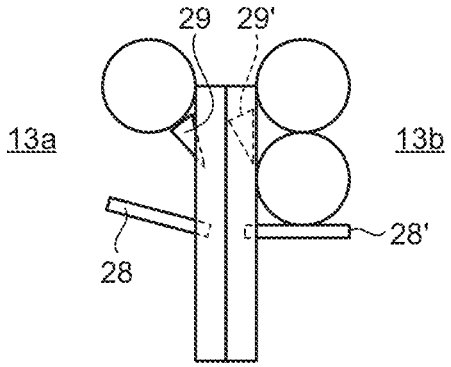

When the pedal stopper pin 34*b* moves to the lower end of the pedal stopper pin support grooves 23*b*4 and 24*c*2, the pedal stopper pin 34*b* comes into contact with the indentation 36*b* on the back side of the turning stopper 36 that has returned to the advanced position. With this operation, movement in the retracting direction is prevented, and the lower pedal 28 returns to the article-absent standby attitude that has advanced to the first article storage passage 13*a* by the biasing force of the lower pedal spring 28*b* as illustrated in FIG. 23D. Consequently, the first out-of-stock detection switch 26 is switched from the off state to the on state to give the on signal to the dispensing controller 60.

Meanwhile, the upper pedal 29 retracts along with the downward movement of the stopper pin 34*a* by being biased by the upper pedal spring. With this operation, the next article is allowed to move downward, and while the next article then comes into contact with the lower pedal 28 that has advanced and is prevented from moving downward, the lower pedal 28 shifts to the article-present standby attitude and returns to the standby state as illustrated in FIG. 23A.

In the driving unit 40, by the clockwise rotation when viewed from the front of the output gear 443, the cam part 443*a* then comes into contact with the basal end 462*a* of the second link lever 462. In this case, the locking part 462*c* is in contact with the right side edge 472 of the left opening, whereby the second link lever 462 is prevented from rotating about the central axis.

Consequently, the locking part 462*c* becomes elastically deformed so as to allow the basal end 462*a* to be close to the locking part 462*c*, and the movement of the cam part 443*a* by the rotation of the output gear 443 is not hindered.

After that, when the cam part 443*a* returns to the standby position by the rotation of the output gear 443, the pressing piece 443*b* presses the contact maker 45*a* of the carrier switch 45, whereby the carrier switch 45 is switched from the off state to the on state to give the on signal to the dispensing controller 60. Immediately after the pressing piece 443*b* presses the contact maker 45*a* of the carrier switch 45, the cam part 443*a* is detached from the basal end 462*a* of the second link lever 462, and the second link lever 462 returns to the original state by the locking part 462*c*. After that, the dispensing controller 60 stops the drive of the motor 43.

In contrast, in the article dispensing apparatus 20, the dispensing controller 60, if having performed input processing on a discharging instruction for the second article given from the vending machine controller 100, drives the motor 43 backward.

When the motor 43 is thus driven backward, the output gear 443 to which the driving force of the motor 43 has been transmitted via the worm gear 441 and the intermediate gear 442 rotates counterclockwise when viewed from the front.

When the output gear 443 rotates counterclockwise when viewed from the front, the pressing piece 443*b* of the output gear 443 separates from the contact maker 45*a* of the carrier switch 45. With this operation, the contact maker 45*a* of the carrier switch 45 is released from the pressed state to be switched from the on state to the off state, and the off signal is given to the dispensing controller 60.

When the cam part 443*a* comes into contact with the basal end 462*a* of the second link lever 462 from above by the rotation of the output gear 443, the second link lever 462 rotates clockwise when viewed from the front. When this second link lever 462 rotates clockwise, the tip 462*b* moves upward. The tip 462*b* thus moves upward to come into contact with the contact piece 351' of the pedal link 35', can move the pedal link 35' upward by a certain distance against the biasing force of the link spring 35*a*', and can besides maintain the state in which the pedal link 35' has been moved upward by the certain distance while the cam part 443*a* is in sliding contact with the basal end 462*a*.

In this case, the second link lever 462, when being in sliding contact with the cam part 443*a*, is adjusted so as to cause a plane containing a part in sliding contact with the cam part 443*a* to be substantially orthogonal to a plane containing its own central axis (the central axis of the second link shaft 42*f*) and the central axis of the output gear 443, although not explicitly illustrated in the drawing.

Along with this upward movement of the pedal link 35', the stopper pin moves upward, and the pedal stopper pin 34*b*' also moves upward.

Figure 24B:
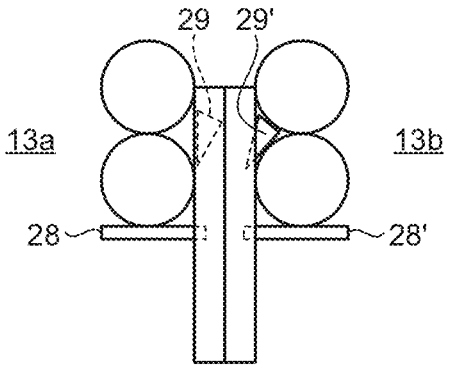

In this process, the stopper pin moves upward while being in contact with the edge wall of the recess 292' of the upper pedal 29', and the upper pedal 29' advances from the initial position against the biasing force of the upper pedal spring as illustrated in FIG. 24B. This advancing of the upper pedal 29' is performed by the upward movement of the stopper pin. When reaching the upper end of the stopper pin insertion holes, the stopper pin comes into contact with the stopper contact part 293' to prevent the upper pedal 29' from retracting.

The upper pedal 29' that has advanced comes into contact with the second lowermost second article (hereinafter, referred to also as a next article) to prevent the next article from moving downward.

Meanwhile, the load of the article in contact with the lower pedal 28' maintained at the advanced position is being applied to the turning stopper 36', and the prevention of retracting has been released by the upward movement of the pedal stopper pin 34*b*', whereby the turning stopper 36' starts retracting.

When the turning stopper 36' thus starts retracting, the pedal operation shaft 361' escapes from the fitted-in part, and the lower pedal 28' starts retracting against the biasing force of the lower pedal spring 28*b*' by the self-weight of the article. The pedal operation shaft 361' of the turning stopper 36' that has escaped from the fitted-in part moves toward a position at which the first guide part and the second guide part cross each other along the first guide part.

Figure 24C:
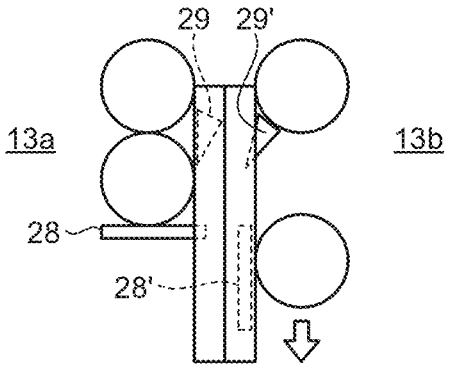

After that, as illustrated in FIG. 24C, the lower pedal 28' retracts by the self-weight of the lowermost article, the lowermost article is allowed to move downward, and the lowermost article is discharged downward. The discharged article is guided to the article discharging port 3*c* via the article chute 5 and is further enabled to be taken out via the article outlet port 2*a*.

When the lowermost article slips through the lower pedal 28', the lower pedal 28' moves toward the advanced position by the elastic biasing force of the lower pedal spring 28*b*', and the turning stopper 36' also moves toward the advanced position by the elastic biasing force of the pedal operation spring. When the lower pedal 28' and the turning stopper 36' move toward the advanced position, the pedal operation shaft 361' that has been maintained at the position at which the first guide part and the second guide part cross each other moves toward the fitted-in part along the second guide part, and the lower pedal 28' and the turning stopper 36' return to the advanced position.

After that, when the contact between the cam part 443*a* and the basal end 462*a* is released by the rotation of the output gear 443, the pedal link 35' is biased by the link spring 35*a*' to move downward.

By this downward movement of the pedal link 35', the stopper pin moves downward, and the pedal stopper pin 34*b*' also moves downward.

Figure 24D:
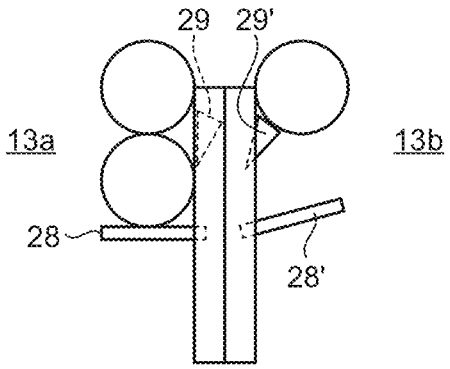

When the pedal stopper pin 34*b*' moves to the lower end of the pedal stopper pin support grooves, the pedal stopper pin 34*b*' comes into contact with the indentation 36*b*' on the back side of the turning stopper 36' that has returned to the advanced position. With this operation, movement in the retracting direction is prevented, and the lower pedal 28' returns to the article-absent standby attitude that has advanced to the second article storage passage 13*b* by the biasing force of the lower pedal spring 28*b*' as illustrated in FIG. 24D. Consequently, the second out-of-stock detection switch 27 is switched from the off state to the on state to give the on signal to the dispensing controller 60.

Meanwhile, the upper pedal 29' retracts along with the downward movement of the stopper pin 34*b*' by being biased by the upper pedal spring. With this operation, the next article is allowed to move downward, and while the next article then comes into contact with the lower pedal 28' having advanced and is prevented from moving downward, the lower pedal 28' shifts to the article-present standby attitude and returns to the standby state as illustrated in FIG. 24A.

In the driving unit 40, by the counterclockwise rotation when viewed from the front of the output gear 443, the cam part 443*a* then comes into contact with the basal end 461*a* of the first link lever 461. In this case, the locking part 461*c* is in contact with the left side edge 471 of the right opening, whereby the first link lever 461 is prevented from rotating about the central axis. Consequently, the locking part 461*c* becomes elastically deformed so as to allow the basal end 461*a* to be close to the locking part 461*c*, and the movement of the cam part 443*a* by the rotation of the output gear 443 is not hindered.

After that, when the cam part 443*a* returns to the standby position by the rotation of the output gear 443, the pressing piece 443*b* presses the contact maker 45*a* of the carrier switch 45, whereby the carrier switch 45 is switched from the off state to the on state to give the on signal to the dispensing controller 60. After that, the dispensing controller 60 stops the drive of the motor 43.

Figure 25:
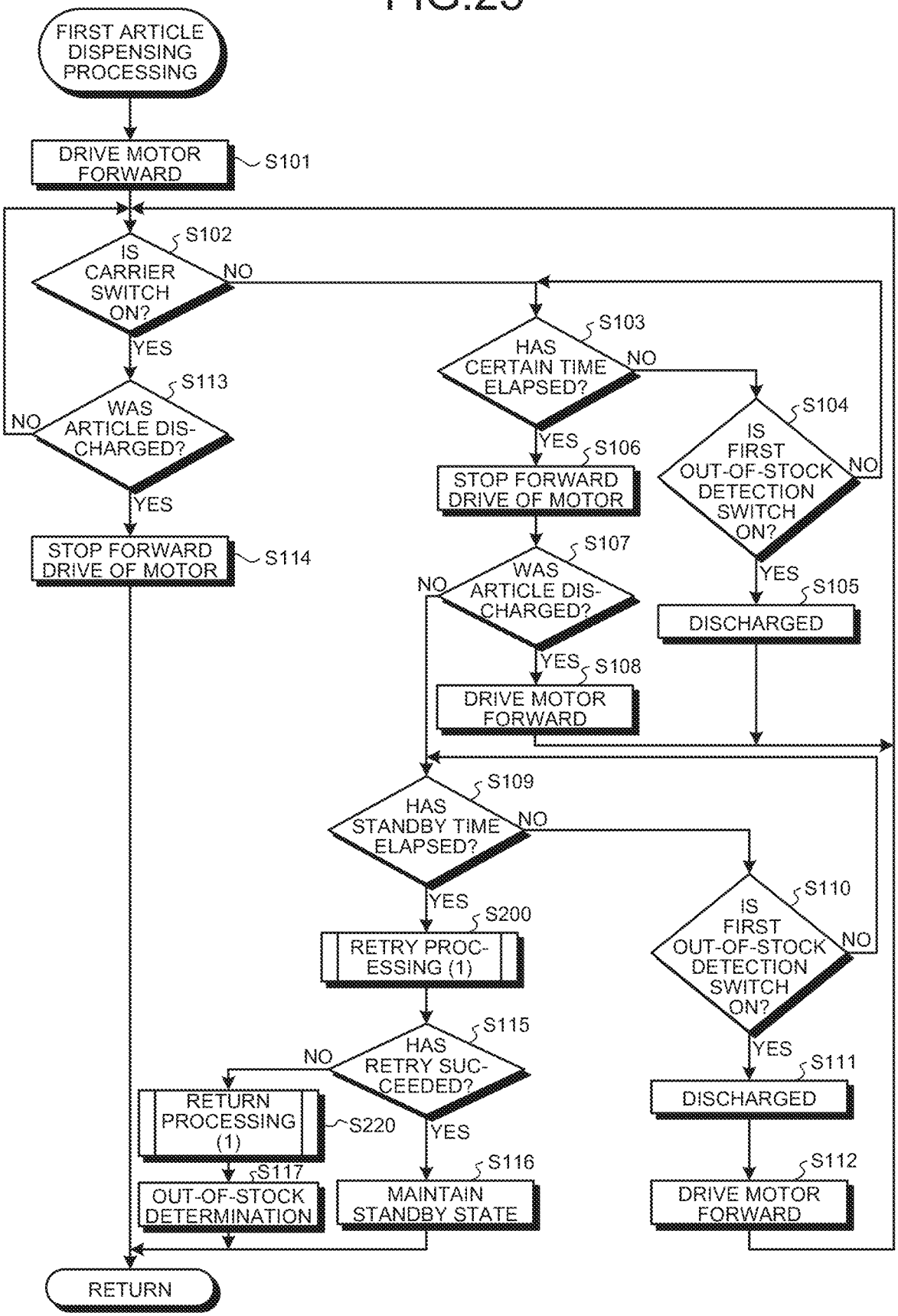
FIG. 25 is a flowchart of the processing details of first article dispensing determination processing that a dispensing controller performs when a discharging instruction for a first article is given thereto from a vending machine controller.

FIG. 25 is a flowchart of the processing details of first article dispensing determination processing that the dispensing controller 60 performs when a discharging instruction for the first article is given thereto from the vending machine controller 100. Although this first article dispensing determination processing is performed simultaneously with the discharging operation of the first article by the article dispensing apparatus 20, the following describes the first article dispensing determination processing separately from the discharging operation for the convenience of description.

In this first article dispensing determination processing, the dispensing controller 60 drives the motor 43 forward (Step S101) and is turned to a waiting state waiting for whether an on signal is given from the carrier switch 45 and an on signal to be given from the first out-of-stock detection switch 26 before a certain time preset in the memory 61 elapses (Step S102, Step S103, Step S104).

If the on signal is given from the first out-of-stock detection switch 26 before the certain time elapses (No at Step S102, No at Step S103, Yes at Step S104), that is, if the lower pedal 28 is turned to the article-absent standby attitude before the certain time elapses, the dispensing controller 60 determines that the first article has been discharged (Step S105) and performs the processing at Step S102.

In contrast, if the certain time has elapsed without the on signal given from the carrier switch 45 (No at Step S102, Yes at Step S103), that is, if the output gear 443 does not return to the standby position even after the certain time has elapsed, the dispensing controller 60 stops the forward drive of the motor 43 (Step S106).

The dispensing controller 60 that has stopped the forward drive of the motor 43 at Step S106 determines whether it was determined that the first article had been discharged at Step S105 before the lapse of the certain time at Step S103 (Step S107). If it is determined at Step S107 that the first article was discharged at Step S105 (Yes at Step S107), the dispensing controller 60 drives the motor 43 forward (Step S108) and performs the processing at Step S102.

If it is not determined at Step S107 that the first article was discharged at Step S105 (No at Step S107), the dispensing controller 60 is turned to a waiting state waiting for an on signal to be given from the first out-of-stock detection switch 26 before a standby time preset in the memory 61 elapses (Step S109, Step S110).

If the on signal is given from the first out-of-stock detection switch 26 before the standby time elapses (No at Step S109, Yes at Step S110), that is, if the lower pedal 28 is turned to the article-absent standby attitude before the standby time elapses, the dispensing controller 60 determines that the first article has been discharged (Step S111), drives the motor 43 forward (Step S112), and performs the processing at Step S102.

If the on signal is given from the carrier switch 45 at Step S102 (Yes at Step S102), that is, if the output gear 443 returns to the standby position, the dispensing controller 60 performs the following processing.

In other words, if it is determined that the first article was discharged at Step S105 or Step S111 (Yes at Step S113), the dispensing controller 60 stops the forward drive of the motor 43 (Step S114) and then returns the procedure to end the present processing.

With this processing, the first article is surely discharged in accordance with the present discharging instruction for the first article, whereby it can be detected that the first article has been dispensed from the article dispensing apparatus 20.

In contrast, if it is not determined that the first article was discharged at Step S105 or Step S111 (No at Step S113), the dispensing controller 60 continues the forward drive of the motor 43 and performs the processing at Step S102.

If the standby time has elapsed without the on signal given from the first out-of-stock detection switch 26 at Step S109 and Step S110 (Yes at Step S109, No at Step S110), that is, if the lower pedal 28 is not turned to the article-absent standby attitude before the standby time elapses, the dispensing controller 60 performs Retry Processing (1) (Step S200).

Figure 26:
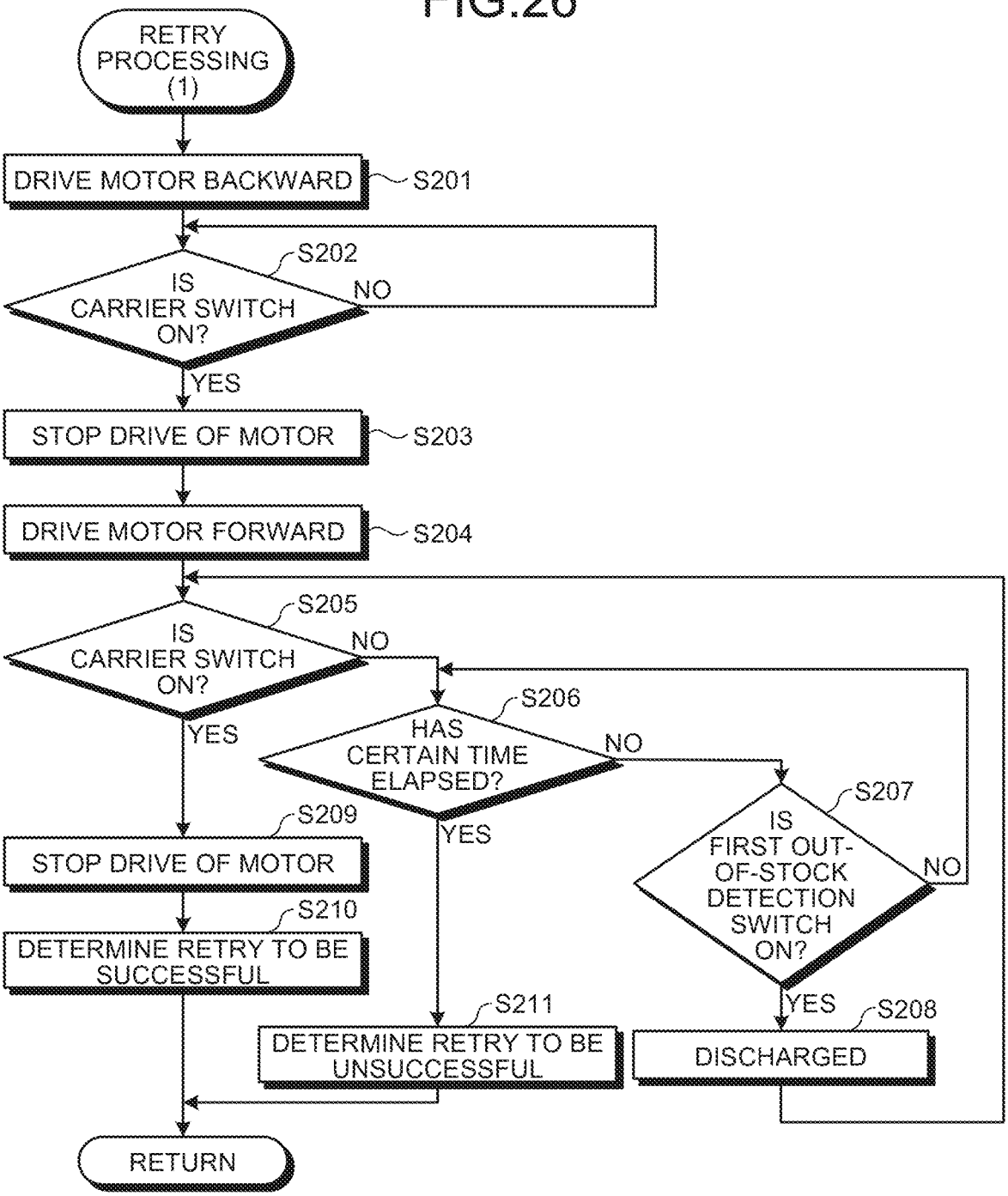
FIG. 26 is a flowchart of the processing details of Retry Processing (1) in the first article dispensing determination processing illustrated in FIG. 25.

FIG. 26 is a flowchart of the processing details of Retry Processing (1) in the first article dispensing determination processing illustrated in FIG. 25.

In this Retry Processing (1), the dispensing controller 60 drives the motor 43 backward and is turned to a waiting state waiting for an on signal to be given from the carrier switch 45 (Step S201, Step S202). When the motor 43 is thus driven backward, the output gear 443 to which the driving force of the motor 43 has been transmitted via the worm gear 441 and the intermediate gear 442 rotates counterclockwise when viewed from the front. Although not explicitly illustrated in this flowchart, also when the motor 43 is driven backward, the dispensing controller 60 monitors whether the on signal is given from the first out-of-stock detection switch 26.

As a result of this waiting, if the on signal is given from the carrier switch 45 (Yes at Step S202), the dispensing controller 60 stops the backward drive of the motor 43 (Step S203) and drives the motor 43 forward again (Step S204).

The dispensing controller 60 is turned to a waiting state waiting for whether an on signal is given from the carrier switch 45 and an on signal to be given from the first out-of-stock detection switch 26 before a preset certain time elapses (Step S205, Step S206, Step S207).

If the on signal is given from the first out-of-stock detection switch 26 before the certain time elapses (No at Step S205, No at Step S206, Yes at Step S207), that is, if the lower pedal 28 is turned to the article-absent standby attitude before the certain time elapses, the dispensing controller 60 determines that the first article has been discharged (Step S208) and performs the processing at Step S205.

After that, if the on signal is given from the carrier switch 45 (Yes at Step S205), that is, if the output gear 443 rotates in the certain time by one rotation clockwise when viewed from the front, the drive of the motor 43 is stopped, and then it is determined that the retry has succeeded (Step S209, Step S210), and after that, the procedure is returned to end the present Retry Processing (1).

In contrast, if the on signal is not given from the carrier switch 45 in the certain time (No at Step S205, Yes at Step S206), the dispensing controller 60 determines that a fault is occurring and that the retry has failed (Step S211) and then returns the procedure to end the present Retry Processing (1).

The dispensing controller 60 that has performed this Retry Processing (1), if the retry has succeeded (Yes at Step S115), maintains the standby state in which the output gear 443 is positioned at the standby position (Step S116) and then returns the procedure to end the present first article dispensing determination processing.

In contrast, if the retry has failed (No at Step S115), the dispensing controller 60 performs Return Processing (1) (Step S220).

Figure 27:
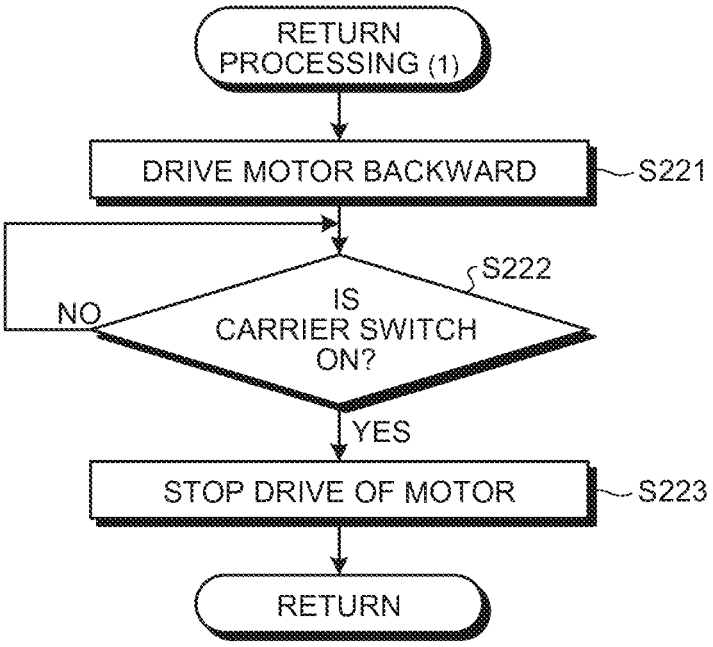
FIG. 27 is a flowchart of the processing details of Return Processing (1) in the first article dispensing determination processing illustrated in FIG. 25.

FIG. 27 is a flowchart of the processing details of Return Processing (1) in the first article dispensing determination processing illustrated in FIG. 25.

In this Return Processing (1), the dispensing controller 60 drives the motor 43 backward and is turned to a waiting state waiting for an on signal to be given from the carrier switch 45 (Step S221, Step S222). When the motor 43 is thus driven backward, the output gear 443 to which the driving force of the motor 43 has been transmitted via the worm gear 441 and the intermediate gear 442 rotates counterclockwise when viewed from the front. When the motor 43 is driven backward, at least the cam part 443*a* of the output gear 443 comes into contact with the basal end 462*a* of the second link lever 462, that is, the cam part 443*a* does not pass by the basal end 462*a*, and even when the motor 43 is driven backward, any adverse effect (discharging the second article from the second article discharging apparatus 20*b*) is not given to the second link lever 462.

As a result of this waiting, if the on signal is given from the carrier switch 45 (Yes at Step S222), the dispensing controller 60 stops the backward drive of the motor 43 (Step S223) and then returns the procedure to end the present Return Processing (1). With this processing, the output gear 443 is positioned at the standby position.

The dispensing controller 60 that has performed this Return Processing (1) determines that the first article in the first article storage passage 13*a* has been out of stock to perform out-of-stock determination (Step S117) and, for example, outputs the fact to the vending machine controller 100. After that, the dispensing controller 60 returns the procedure to end the present processing. With this processing, it is determined that the first article has been out of stock, an out-of-stock lamp or the like is lit, and the sales of the first article can be suspended.

Figure 28:
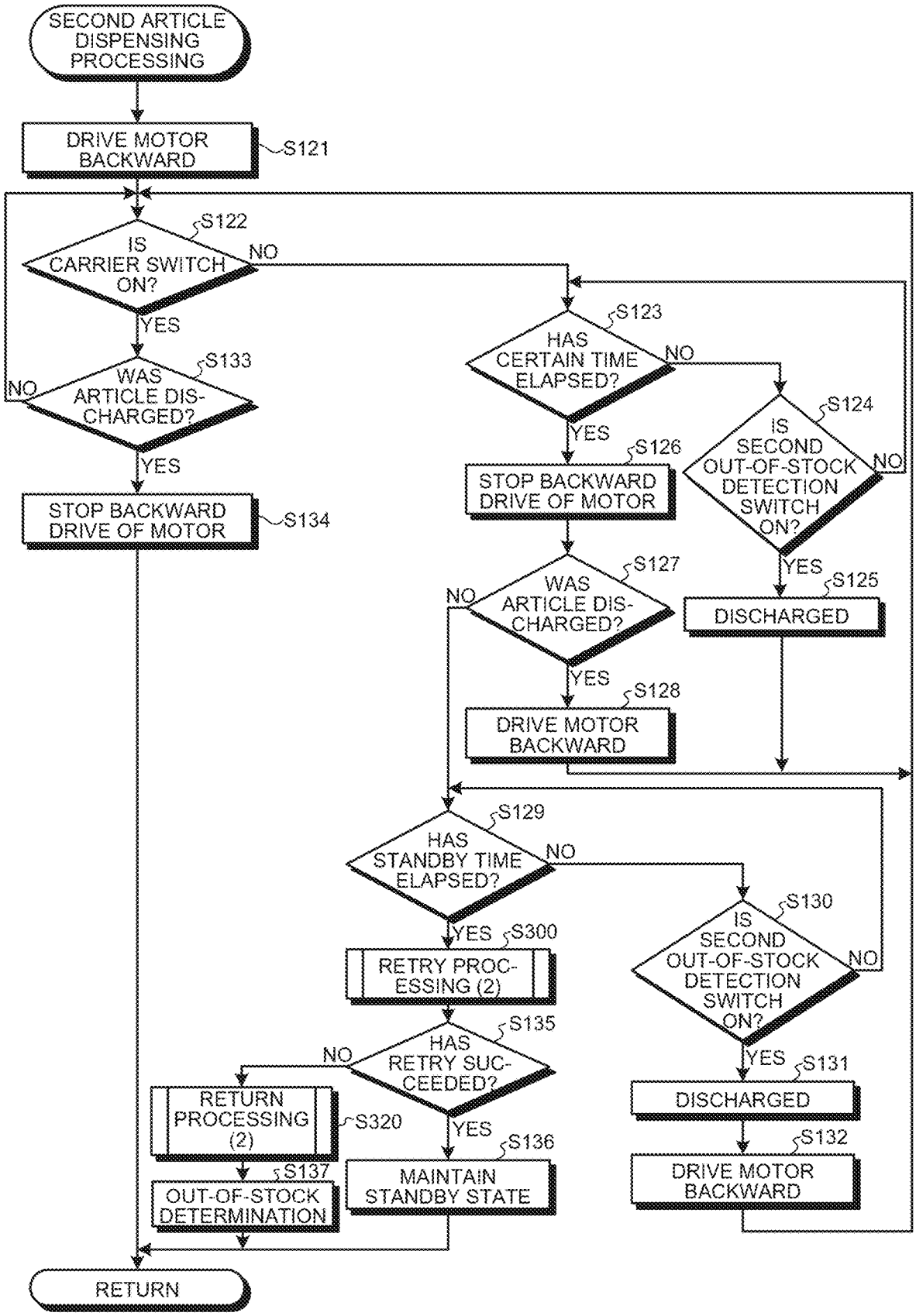
FIG. 28 is a flowchart of the processing details of second article dispensing determination processing that the dispensing controller performs when a discharging instruction for a second article is given thereto from the vending machine controller.

FIG. 28 is a flowchart of the processing details of second article dispensing determination processing that the dispensing controller 60 performs when a discharging instruction for the second article is given thereto from the vending machine controller 100. Although this second article dispensing determination processing is performed simultaneously with the discharging operation of the second article by the article dispensing apparatus 20, the following describes the second article dispensing determination processing separately from the discharging operation for the convenience of description.

In this second article dispensing determination processing, the dispensing controller 60 drives the motor 43 backward (Step S121) and is turned to a waiting state waiting for whether an on signal is given from the carrier switch 45 and an on signal to be given from the second out-of-stock detection switch 27 before a certain time preset in the memory 61 elapses (Step S122, Step S123, Step S124).

If the on signal is given from the second out-of-stock detection switch 27 before the certain time elapses (No at Step S122, No at Step S123, Yes at Step S124), that is, if the lower pedal 28' is turned to the article-absent standby attitude before the certain time elapses, the dispensing controller 60 determines that the second article has been discharged (Step S125) and performs the processing at Step S122.

In contrast, if the certain time has elapsed without the on signal given from the carrier switch 45 (No at Step S122, Yes at Step S123), that is, if the output gear 443 does not return to the standby position, although the certain time has elapsed, the dispensing controller 60 stops the backward drive of the motor 43 (Step S126).

The dispensing controller 60 that has stopped the backward drive of the motor 43 at Step S126 determines whether it was determined that the second article had been discharged at Step S125 before the lapse of the certain time at Step S123 (Step S127). If it is determined at Step S127 that the second article was discharged at Step S125 (Yes at Step S127), the dispensing controller 60 drives the motor 43 backward (Step S128) and performs the processing at Step S122.

If it is not determined at Step S127 that the second article was discharged at Step S125 (No at Step S127), the dispensing controller 60 is turned to a waiting state waiting for an on signal to be given from the second out-of-stock detection switch 27 before a standby time preset in the memory 61 elapses (Step S129, Step S130).

If the on signal is given from the second out-of-stock detection switch 27 before the standby time elapses (No at Step S129, Yes at Step S130), that is, if the lower pedal 28' is turned to the article-absent standby attitude before the standby time elapses, the dispensing controller 60 determines that the second article has been discharged (Step S131), drives the motor 43 backward (Step S132), and performs the processing at Step S122.

If the on signal is given from the carrier switch 45 at Step S122 (Yes at Step S122), that is, if the output gear 443 returns to the standby position, the dispensing controller 60 performs the following processing.

In other words, if it is determined that the second article was discharged at Step S125 or Step S131 (Yes at Step S133), the dispensing controller 60 stops the backward drive of the motor 43 (Step S134) and then returns the procedure to end the present processing.

With this processing, the second article is surely discharged in accordance with the present discharging instruction for the second article, whereby it can be detected that the second article has been dispensed from the article dispensing apparatus 20.

In contrast, if it is not determined that the second article was discharged at Step S125 or Step S131 (No at Step S133), the dispensing controller 60 continues the backward drive of the motor 43 and performs the processing at Step S122.

If the standby time has elapsed without the on signal given from the second out-of-stock detection switch 27 at Step S129 and Step S130 (Yes at Step S129, No at Step S130), that is, if the lower pedal 28' is not turned to the article-absent standby attitude before the standby time elapses, the dispensing controller 60 performs Retry Processing (2) (Step S300).

Figure 29:
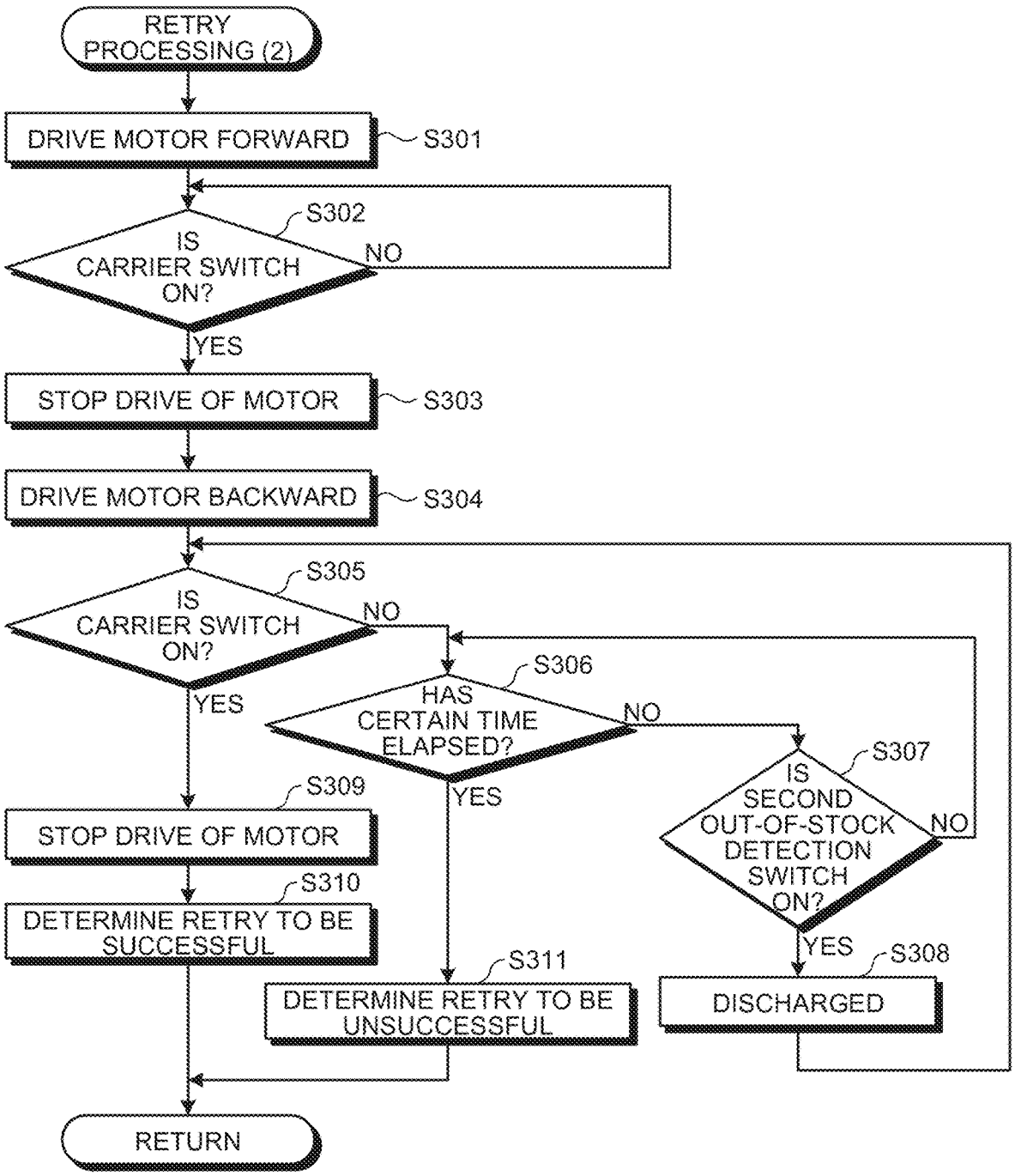
FIG. 29 is a flowchart of the processing details of Retry Processing (2) in the second article dispensing determination processing illustrated in FIG. 28.

FIG. 29 is a flowchart of the processing details of Retry Processing (2) in the second article dispensing determination processing illustrated in FIG. 28.

In this Retry Processing (2), the dispensing controller 60 drives the motor 43 forward and is turned to a waiting state waiting for an on signal to be given from the carrier switch 45 (Step S301, Step S302). When the motor 43 is thus driven forward, the output gear 443 to which the driving force of the motor 43 has been transmitted via the worm gear 441 and the intermediate gear 442 rotates clockwise when viewed from the front. Although not explicitly illustrated in this flowchart, also when the motor 43 is driven forward, the dispensing controller 60 monitors whether the on signal is given from the second out-of-stock detection switch 27.

As a result of this waiting, if the on signal is given from the carrier switch 45 (Yes at Step S302), the dispensing controller 60 stops the forward drive of the motor 43 (Step S303) and drives the motor 43 backward again (Step S304).

The dispensing controller 60 is turned to a waiting state waiting for whether an on signal is given from the carrier switch 45 and an on signal to be given from the second out-of-stock detection switch 27 before a preset certain time elapses (Step S305, Step S306, Step S307).

If the on signal is given from the second out-of-stock detection switch 27 before the certain time elapses (No at Step S305, No at Step S306, Yes at Step S307), that is, if the lower pedal 28' is turned to the article-absent standby attitude before the certain time elapses, the dispensing controller 60 determines that the second article has been discharged (Step S308) and performs the processing at Step S305.

After that, if the on signal is given from the carrier switch 45 (Yes at Step S305), that is, if the output gear 443 rotates in the certain time by one rotation counterclockwise when viewed from the front, the drive of the motor 43 is stopped, and then it is determined that the retry has succeeded (Step S309, Step S310), and after that, the procedure is returned to end the present Retry Processing (2).

In contrast, if the on signal is not given from the carrier switch 45 in the certain time (No at Step S305, Yes at Step S306), the dispensing controller 60 determines that a fault is occurring and that the retry has failed (Step S311) and then returns the procedure to end the present Retry Processing (2).

The dispensing controller 60 that has performed this Retry Processing (2), if the retry has succeeded (Yes at Step S135), maintains the standby state in which the output gear 443 is positioned at the standby position (Step S136) and then returns the procedure to end the present second article dispensing determination processing.

In contrast, if the retry has failed (No at Step S135), the dispensing controller 60 performs Return Processing (2) (Step S320).

Figure 30:
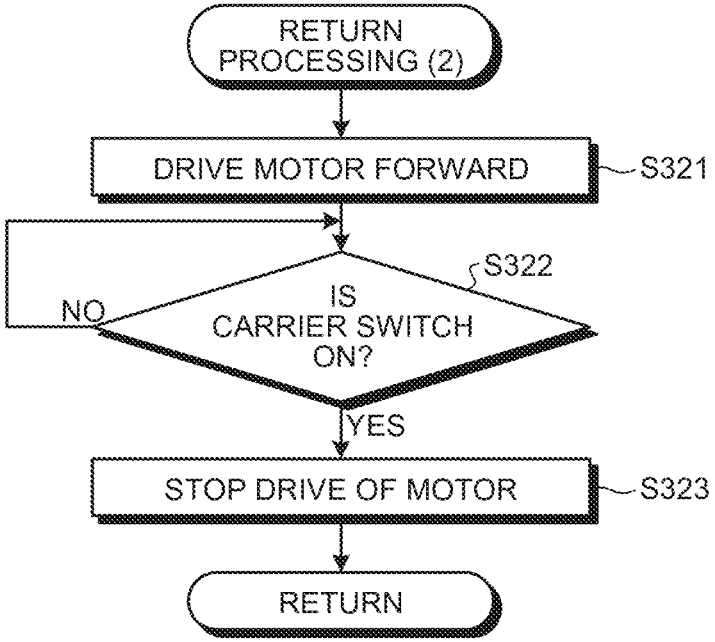
FIG. 30 is a flowchart of the processing details of Return Processing (2) in the second article dispensing determination processing illustrated in FIG. 28.

FIG. 30 is a flowchart of the processing details of Return Processing (2) in the second article dispensing determination processing illustrated in FIG. 28.

In this Return Processing (2), the dispensing controller 60 drives the motor 43 forward and is turned to a waiting state waiting for an on signal to be given from the carrier switch 45 (Step S321, Step S322). When the motor 43 is thus driven forward, the output gear 443 to which the driving force of the motor 43 has been transmitted via the worm gear 441 and the intermediate gear 442 rotates clockwise when viewed from the front.

As a result of this waiting, if the on signal is given from the carrier switch 45 (Yes at Step S322), the dispensing controller 60 stops the forward drive of the motor 43 (Step S323) and then returns the procedure to end the present Return Processing (2). With this processing, the output gear 443 is positioned at the standby position.

The dispensing controller 60 that has performed this Return Processing (2) determines that the second article in the second article storage passage 13*b* has been out of stock to perform out-of-stock determination (Step S137) and, for example, outputs the fact to the vending machine controller 100. After that, the dispensing controller 60 returns the procedure to end the present processing. With this processing, it is determined that the second article has been out of stock, an out-of-stock lamp or the like is lit, and the sales of the second article can be suspended.

The article discharging apparatus 20 as described above in which the dispensing controller 60, when the discharging instruction for the first article or the second article is given from the vending machine controller 100 to drive the first article discharging apparatus 20*a* or the second article discharging apparatus 20*b*, determines that the first article or the second article has been discharged from the article storage passage 13 by being given the on signal after the first out-of-stock detection switch 26 or the second out-of-stock detection switch 27 is turned to the on state can surely detect that the first article or the second article has been dispensed without using a detector or the like that detects the dispensing of the article.

The dispensing of the first article or the second article can be thus surely detected, thereby eliminating error adjustment in the management of the quantity of stock of the article in the article storage passage 13 or the management of the sales of the article in the article storage passage 13 and besides avoiding troubles and the like about the dispensing of the article with article purchasers.

The article dispensing apparatus 20 in which the dispensing controller 60, when the output gear 443 rotated from the standby position does not return to the standby position in the preset set time, continuously rotates the output gear 443 in the same direction (refer to Step S108, Step S128) even after the lapse of the set time if the on signals is given from the out-of-stock detection switches 26 and 27 in the set time can prevent the output gear 443 from being rotated in the opposite direction to dispense the second article or the first article after the first article or the second article has been dispensed.

The article dispensing apparatus 20 in which the dispensing controller 60, when the output gear 443 rotated from the standby position does not return to the standby position in the preset set time, stops the rotation of the output gear 443 and determines whether the on signal is given from the out-of-stock detection switches 26 and 27 in the preset standby time if the on signal is not given from the out-of-stock detection switches 26 and 27 in the set time can surely detect that the first article or the second article has been dispensed in the standby time even after the lapse of the set time.

The dispensing controller 60, if the on signal is given thereto from the out-of-stock detection switches 26 and 27 in the standby time, rotates the output gear 443 in the same direction after the lapse of the standby time (refer to Step S112, Step S132), and the output gear 443 can be prevented from being rotated in the opposite direction to dispense the second article or the first article after the first article or the second article has been dispensed. In contrast, the dispensing controller 60, if the on signal is not given thereto from the out-of-stock detection switches 26 and 27 in the standby time, rotates the output gear 443 in the opposite direction and performs the retry processing, and the dispensing of the first article or the second article can be performed again.

The article dispensing apparatus 20 in which the dispensing controller 60, if the discharging of the first article or the second article is not determined when the output gear 443 returns to the standby position, continues the forward drive or the backward drive of the motor 43 (refer to Step S113, Step S133) and produces the effect described later. In other words, if the discharging of the first article or the second article is not determined even when the output gear 443 returns to the standby position, it means that the lower pedals 28 and 28' are not turned to the article-absent standby attitude once after the motor 43 was driven, and there is a possibility that the lower pedals 28 and 28' are held at an attitude retracted from the article storage passage 13 and that the articles in the article storage passage 13 continue to be discharged downward. Given this situation, the drive of the motor 43 is maintained to cause the lower pedals 28 and 28' and the upper pedals 29 and 29' to advance and retract to and from the article storage passage 13 again, thereby keeping many articles in the article storage passage 13 from being dispensed.

The article dispensing apparatus 20 in which the first article discharging apparatus 20*a* includes the motor 43 as the driving source for the first article discharging apparatus 20*a* and the second article discharging apparatus 20*b* and the driving unit 40 that alternatively selects the first article discharging apparatus 20*a* or the second article discharging apparatus 20*b* when a discharging instruction has been given in accordance with the discharging instruction to give the driving force from the motor 43 to the selected article discharging apparatus can reduce the number of driving sources relative to the number of discharging mechanisms and can reduce manufacturing costs. Besides, the first article discharging apparatus 20*a* includes the driving unit 40 including the motor 43, and the first article discharging apparatus 20*a* alone can also be used. In other words, the first article discharging apparatus 20*a* can be used not only for the article storage rack 10 including an even number of article storage passages 13 arranged fore and aft as described above but also for the article storage rack 10 including an odd number of article storage passages 13 arranged fore and aft. Consequently, the article dispensing apparatus 20 can reduce manufacturing costs and can make provisions flexibly in accordance with the number of the article storage passages 13 adjacent to each other fore and aft.

The article dispensing apparatus 20 in which the dispensing controller 60 performs Return Processing (1) and (2) that, when the output gear 443 rotated from the standby position in one direction or another direction does not return to the standby position in a certain time, rotate the output gear 443 in the other direction or the one direction to return the output gear 443 to the standby position can position the output gear 443 at the standby position and prepare for the sales of articles other than an article the sales of which have been suspended. In other words, even when the sales of the article from either the first article discharging apparatus 20*a* or the second article discharging apparatus 20*b* have been suspended, the other can continue discharging the article, whereby careful operation corresponding to each of the article storage passages 13 can be achieved, and losses of sales opportunities can be reduced.

The article dispensing apparatus 20 in which the motor 43 as the driving source is a DC motor is less susceptible to regional voltage and/or frequency fluctuations and can be installed at various locations.

The article dispensing apparatus 20 in which the first out-of-stock detection switch 26 and the second out-of-stock detection switch 27 are installed in the first article discharging apparatus 20*a* can use the first article discharging apparatus 20*a* alone, can also thereby make provisions flexibly in accordance with the number of the article storage passages 13 adjacent to each other fore and aft, and can put the harnesses together in the first article discharging apparatus 20*a*, because the electric parts are arranged only in the first article discharging apparatus 20*a*.

Although a preferred embodiment of the disclosure has been described, the disclosure is not limited to this embodiment, and various alterations can be made.

In the embodiment, after the certain time elapses at Step S103 and Step S123 in the first article dispensing determination processing and the second article dispensing determination processing, the drive of the motor 43 is once stopped, and the determination at Step S107 and Step S127 is then performed; in the disclosure, determination whether it is determined to be discharged may be performed after the certain time elapses, and only when it is not determined to be discharged, the drive of the motor may be stopped, and determination whether the on signal from the first out-of-stock detection switch 26 or the second out-of-stock detection switch 27 is given in the standby time may be performed.

Although not especially described in the embodiment, in the disclosure, in the article dispensing determination processing, the input of the on signal from the out-of-stock detection switch may be prohibited in a preset prohibited time after the motor was driven.

According to some embodiments, the controller determines that the article has been dispensed from the article storage passage by the fact that the out-of-stock detection switch is turned to the first state when the article discharging apparatus is driven. Thus, some embodiments produce the effect of making it possible to surely detect the dispensing of the article from the article storage passage.

Additional advantages and modifications will readily occur to those skilled in the art. Therefore, the invention in its broader aspects is not limited to the specific details and representative embodiments shown and described herein.

Accordingly, various modifications may be made without departing from the spirit or scope of the general inventive concept as defined by the appended claims and their equivalents.

What is claimed is:

1. An article dispensing apparatus comprising:

an article discharging apparatus including:

a lower pedal swingably arranged on a base through a swinging support shaft to cause a tip of the lower pedal to advance to and retract from an article storage passage configured to store therein charged articles in an up-and-down direction, the lower pedal including a plate-shaped pedal main body at one side of the lower pedal for supporting the articles, and a basal end at another side of the lower pedal opposite to the one side in respect to the swinging support shaft; and an upper pedal swingably arranged on the base to cause a tip of the upper pedal to advance and retract to and from the article storage passage in an area above the lower pedal, the article discharging apparatus being configured to:

advance the lower pedal to the article storage passage while retracting the upper pedal from the article storage passage to cause the lower pedal to place a lowermost article on an upper face of the lower pedal while turning to a first standby attitude to prevent the lowermost article from moving downward in a standby state; and retract the lower pedal from the article storage passage to discharge the lowermost article downward while advancing the upper pedal to the article storage passage to come into contact with a second lowermost article when being driven, the lower pedal being configured to be turned to a second standby attitude in which the tip of the lower pedal is positioned at an upper position than the first standby attitude when no article is placed on the upper face when advanced to the article storage passage;

an out-of-stock detection switch configured to:

be turned to a first state when the lower pedal is turned to the second standby attitude; and be turned to a second state when the lower pedal is turned to any attitude other than the second standby attitude;

an out-of-stock link arranged coaxially to and rotatably about the swinging support shaft to press the out-of-stock detection switch when the lower pedal is in the second standby attitude; and a controller configured to determine that an article has been dispensed from the article storage passage by the out-of-stock detection switch being turned to the first state when the article discharging apparatus is driven, wherein when the lower pedal turns to the second standby attitude, the basal end presses the out-of-stock link and the out-of-stock link rotates about the swinging support shaft to press an out-of-stock pressing part to thereby press the out-of-stock detection switch causing the out-of-stock detection switch to be turned to the first state.

2. The article dispensing apparatus according to claim 1, further comprising an output member arranged rotatably about a central axis of the output member, the output member being configured to put the article discharging apparatus in the standby state when the output member is positioned at a standby position, and drive the article discharging apparatus when the output member rotates from the standby position, wherein the controller is configured to determine that an article has been dispensed from the article storage passage by the out-of-stock detection switch being turned to the first state when the output member is rotated from the standby position.

3. The article dispensing apparatus according to claim 1, wherein the out-of-stock link includes an out-of-stock contact part protruding in one direction along an axial direction of the swinging support shaft and toward the basal end to contact the basal end, and a pressing part protruding in another direction opposite to the one direction to press the out-of-stock detection switch, and the out-of-stock link is configured so that when the lower pedal is in the first standby attitude, the out-of-stock contact part and the basal end are spaced away from each other in a circumferential direction of the swinging support shaft, and when the lower pedal is in the second standby attitude, the out-of-stock contact part and the basal end of the lower pedal contact each other and the pressing part presses the out-of-stock switch causing the out-of-stock detection switch to be turned to the first state.

4. An article dispensing apparatus comprising:

an article discharging apparatus including:

a lower pedal swingably arranged on a base to cause a tip of the lower pedal to advance to and retract from an article storage passage configured to store therein charged articles in an up-and-down direction; and an upper pedal swingably arranged on the base to cause a tip of the upper pedal to advance and retract to and from the article storage passage in an area above the lower pedal, the article discharging apparatus being configured to:

advance the lower pedal to the article storage passage while retracting the upper pedal from the article storage passage to cause the lower pedal to place a lowermost article on an upper face of the lower pedal to be turned to a first standby attitude to prevent the lowermost article from moving downward in a standby state; and retract the lower pedal from the article storage passage to discharge the lowermost article downward while advancing the upper pedal to the article storage passage to come into contact with a second lowermost article when being driven, the lower pedal being configured to be turned to a second standby attitude in which the tip of the lower pedal is positioned at an upper position than the first standby attitude when no article is placed on the upper face when advanced to the article storage passage;

an out-of-stock detection switch configured to:

be turned to a first state when the lower pedal is turned to the second standby attitude; and be turned to a second state when the lower pedal is turned to any attitude other than the second standby attitude;

an output member arranged rotatably about a central axis of the output member, the output member being configured to put the article discharging apparatus in the standby state when the output member is positioned at a standby position, and drive the article discharging apparatus when the output member rotates from the standby position; and a controller configured to determine that an article has been dispensed from the article storage passage by the out-of-stock detection switch being turned to the first state when the article discharging apparatus is driven and the output member is rotated from the standby position, wherein when the output member that has been rotated from the standby position does not return to the standby position within a preset set time, the controller is configured to rotate the output member continuously in same direction even after a lapse of the set time when the out-of-stock detection switch is turned to the first state within the set time; and stop the rotation of the output member and determine whether the out-of-stock detection switch is turned to the first state within a preset standby time when the out-of-stock detection switch is not turned to the first state in the set time.

5. The article dispensing apparatus according to claim 4, wherein the controller is configured to:

rotate the output member in the same direction after a lapse of the standby time when the out-of-stock detection switch is turned to the first state within the standby time; and rotate the output member in an opposite direction when the out-of-stock detection switch is not turned to the first state within the standby time.

* * * * *